US012366395B2

(12) United States Patent
Laughman et al.

(10) Patent No.: US 12,366,395 B2
(45) **Date of Patent: *Jul. 22, 2025**

(54) SYSTEM AND METHOD FOR MONITORING AN OPERATION OF A VAPOR COMPRESSION CYCLE

(71) Applicant: Mitsubishi Electric Research Laboratories, Inc., Cambridge, MA (US)

(72) Inventors: Christopher Laughman, Waltham, MA (US); Vedang Mohanrao Deshpande, Attleboro, MA (US)

(73) Assignee: Mitsubishi Electric Research Laboratories, Inc., Cambridge, MA (US)

( * ) Notice: Subject to any disclaimer, the term of this patent is extended or adjusted under 35 U.S.C. 154(b) by 234 days.

This patent is subject to a terminal disclaimer.

(21) Appl. No.: 18/063,974

(22) Filed: Dec. 9, 2022

(65) Prior Publication Data

US 2023/0392845 A1 Dec. 7, 2023

Related U.S. Application Data

(60) Provisional application No. 63/348,923, filed on Jun. 3, 2022.

(51) Int. Cl.
*F25B 49/02* (2006.01)

(52) U.S. Cl.
CPC ..... *F25B 49/022* (2013.01); *F25B 2500/19* (2013.01); *F25B 2700/04* (2013.01); *F25B 2700/193* (2013.01); *F25B 2700/2115* (2013.01)

(58) Field of Classification Search
CPC ..... F25B 49/022; F25B 2500/19; F25B 2500/22; F25B 2500/222; F24F 11/36
See application file for complete search history.

(56) References Cited

U.S. PATENT DOCUMENTS

| | | | | |
|---|---|---|---|---|
| 7,159,408 | B2 | 9/2007 | Sadegh | |
| 9,037,302 | B2 | 5/2015 | O'Neill | |
| 10,352,579 | B2 | 7/2019 | Guo | |
| 2006/0021362 | A1 * | 2/2006 | Sadegh | F25B 49/005 62/149 |

OTHER PUBLICATIONS

Albers, D. J., Blancquart, P. A., Levine, M. E., Seylabi, E. E., & Stuart, A. (2019). Ensemble Kalman methods with constraints. Inverse Problems, 35(9), 095007.

* cited by examiner

*Primary Examiner* — Jonathan Bradford
(74) *Attorney, Agent, or Firm* — Gene Vinokur

(57) ABSTRACT

A method and system that describe collecting digital representation of observed variables of the operation of the vapor compression cycle over multiple instances of time and executing a constrained ensemble Kalman smoother for each instance of time to estimate the state variables of the vapor compression cycle for each instance of time. The constrained ensemble Kalman smoother updates the state variables over a sequence of time instances within a smoothing window by solving a series of constrained optimization problems in a range of a covariance, for which constraints are enforced for every variable in the smoothing window for every instance of the constrained optimization problems. The method and system further involve outputting, based on the estimates of the state variables, estimates of variables of the vapor compression cycle at each instance of time.

23 Claims, 10 Drawing Sheets

SYSTEM AND METHOD FOR MONITORING AN OPERATION OF A VAPOR COMPRESSION CYCLE

TECHNICAL FIELD

This present disclosure relates to vapor compression cycles and more particularly to a system and a method for monitoring an operation of a vapor compression cycle.

BACKGROUND

Vapor compression cycles represent a fundamental technology in contemporary society because of their wide use in air-conditioning and space heating applications. The role of these cycles is expected to grow in future years as the they provide an effective means for decarbonizing heating systems and utilizing electrical energy generated by renewable sources, such as photovoltaic or wind power. There is thus widespread interest in further developing vapor compression cycle technology so that they are both energy efficient and satisfy performance requirements related to user health and comfort in buildings.

Measurement-based methods for understanding and predicting behavior of vapor compression cycles provide a path to realizing their efficient operation. Because these cycles utilize refrigerants that can contribute to global warming, climate-based concerns motivate the development of monitoring methods that alert a system maintainer in case of leak of the refrigerant, to avoid discharge of refrigerant into atmosphere as well as mitigate the reduction in energy efficiency that accompanies such events. Technology that can be used to effectively monitor the behavior of vapor compression cycles in a reliable and cost-effective fashion could therefore be of significant value to both an equipment owner and society at large.

However, vapor compression cycles have characteristics that pose distinct challenges when developing monitoring methods. For example, the high cost of some sensor types, such as mass flow rate or pressures, can make it difficult to obtain measurements of informative internal system variables. In addition, there exist internal variables for vapor compression cycles for which no widespread or reliable methods of measurement exist. For example, the ratio of a mass of vapor refrigerant to a total mass of refrigerant in an evaporating flow at a certain location in a heat exchanger provides useful information that pertains to heat transfer effectiveness or equipment durability, but reliable sensors for directly measuring this information are not commercially available.

Accordingly, there is a need for a system and a method for estimation of variables of the vapor compression cycle that are difficult to measure directly.

SUMMARY

It is an object of some embodiments to provide a state estimation method that can estimate all or at least a majority of state variables of a model of a vapor compression cycle that are indicative of performance of a vapor compression cycle. The state variables may include unobserved variables of the vapor compression cycle. The unobserved variables correspond to the variables that are difficult to measure or cannot be measured directly, for example, an amount of refrigerant in the vapor compression cycle. Additionally or alternatively, it is an object of some embodiments to provide such a state estimation method that can be used for an extended period of time to monitor a vapor compression cycle of complexity present in modern commercial, office, and residential buildings.

Some embodiments are based on a recognition that many of quantities of interest for the vapor compression cycles are spatially distributed in extent, rather than local. Because behavior of a heat pump is described by a set of nonlinear partial differential equations, quantities that describe the behavior over a spatial region are integrated over that spatial extent. For example, as a total mass of refrigerant in a vapor compression cycle is distributed throughout all of pipes and cycle components, a single-point measurement in space is insufficient to estimate total mass of refrigerant. Instead, a series of mass estimates at locations that are distributed across the spatial extent of the vapor compression cycle is needed to characterize the distribution of mass throughout the vapor compression cycle. Similar concerns also affect the estimates of thermal energy delivered by a given heat exchanger, though in this case the quantity of interest is distributed across a smaller spatial extent (one heat exchanger) rather than the entire vapor compression cycle. As a result, estimates of local quantities at many locations around the vapor compression cycle need to be obtained to synthesize them into spatially-distributed output of interest.

Additionally or alternatively, it is an object of some embodiments to provide a state estimation method that can estimate all or at least a majority of state variables of a model of the vapor compression cycle with a prescribed accuracy. The accuracy of the state estimates is vital in many applications for vapor compression cycles, such as in performance monitoring or design. For example, as many heat pumps are often installed globally every year, even small inaccuracies in refrigerant leak assessments may represent large total errors in estimates of an amount of refrigerant entering the environment. In addition, the use of state estimates in the design process may have a direct impact on the operation of large numbers of commercially available air-conditioners.

Some embodiments are based on a recognition that probabilistic estimators, such as a Kalman-based estimator such as a Kalman filter or Kalman smoother, can increase the accuracy of state estimation of the unobserved variables of a vapor compression cycle. Kalman-based estimators use a series of measurements observed over time, that include statistical noise and other inaccuracies, to produce estimates of observed and unobserved variables by estimating a joint probability distribution over the state variables for each time frame. In theory, Kalman-based estimators can be used to estimate all or at least a majority of state variables that are indicative of the performance of the vapor compression cycle.

Some embodiments are based on a recognition that Kalman smoothers are able to generate more accurate predictions of the state variables than Kalman filters, as Kalman smoothers are non-causal and can more accurately describe the spatial distribution of the variables of interest. Whereas the Kalman filters are focused on applications in which state predictions are generated purely on basis of past data, Kalman smoothers generate state estimates for a given point in time using data that both precedes and follows that point. This higher accuracy is important for achieving industrial performance benchmarks for vapor compression cycles, such as for estimating refrigerant mass or thermal energy delivered.

However, standard implementations of the Kalman-based estimators, including Kalman smoothers, do not work well with large number of state variables. Dynamic models of the vapor compression cycles have many variables and states, as the dynamic models are formulated by discretizing the partial differential equations for the mass, momentum, and energy balances that describe fluid and thermal interactions in the vapor compression cycle. Since finer discretizations often yield more accurate predictions of the performance, and since complex vapor compression cycles often have many heat exchangers, models of the vapor compression cycle have a commensurately large number of equations and state variables. The state estimation method must be able to scale to such complex vapor compression cycles while remaining computationally tractable.

Some embodiments are therefore based on a recognition that the structure of a Kalman-based estimator for a vapor compression cycle must reflect the requirements of estimating a large number of state variables. For example, an ensemble Kalman filter is a recursive filter suitable for problems with a large number of state variables. The ensemble Kalman filter originated as a version of the Kalman filter for large problems in which a covariance matrix is replaced by a sample covariance. The ensemble Kalman filter is related to a particle filter, but the ensemble Kalman filter makes an additional assumption that all probability distributions involved are Gaussian; when it is applicable, it is more efficient than the particle filter.

Some embodiments are based on recognition that the application of the Ensemble Kalman approaches to smoothing problems results in problems with scale when applied to long smoothing windows for large systems, such as vapor compression cycles. In such a case, a size of the smoothing problem grows as a product nl of a number of state variables n and a number of data points in the smoothing window l.

To that end, one embodiment of the present disclosure defines a state estimation method using an ensemble Kalman smoother that implements a coordinate transformation so that update is performed in a covariance range, rather than a space of original state variables. This coordinate transformation ensures that the size of the variable in estimation problem is only dependent upon the number of members of the ensemble, and is independent of number of state variables n and a length of the smoothing window l. An ensemble Kalman smoother that implements this coordinate transformation can thus generate state estimates over long time series of data in a computationally tractable way and provide accurate state estimates by using information from the entire duration of the smoothing window.

These state estimators, such as the ensemble Kalman smoother, use solvers to integrate the dynamic model between times at which measurement data exists. Once the dynamic model is integrated forward over a time interval, state corrections that are computed as a result of deviations between predicted behavior and measured data need to satisfy constraints of the dynamic model to ensure correct operation of the dynamic model over future time instances. For example, refrigerant pressure in a heat exchanger must decrease in a direction of flow to satisfy fundamental physical relationships in the vapor compression cycle. If such a constraint on the refrigerant pressure is not satisfied after the state correction is applied at a given time, the solver may not be able to successfully integrate the dynamic model forward over the next time interval because perturbed pressures may cause nonphysical changes in the direction of the flow and violate fundamental assumptions of the dynamic model.

To address such a problem, some embodiments are based on a recognition that the ensemble Kalman smoother needs to satisfy a set of constraints to successfully propagate the dynamic models forward in time. There is therefore a need to formulate a constrained ensemble Kalman smoother to estimate the unobserved variables of the vapor compression cycle. Some embodiments are based on the realization that the ensemble Kalman smoother can be written as an optimization problem, which permits enforcement of the constraints. Such an optimization problem represents the constrained ensemble Kalman smoother.

Further, some embodiments are based on the realization that the constraints need to be enforced on the state updates at every time instant because enforcing the constraints for one time instant may yield state updates that violate the constraints at other time instants. Enforcing the constraints on the state updates at every time instant, rather than only at a current time instant, guarantees that all of the constraints are met for all of the state variables.

Some variables, including the refrigerant mass in the vapor compression cycle, vary slowly with time and can be assumed to be constant over relatively short periods over which the state estimation method is performed using Kalman smoother. This information about the slowly varying variables can be represented by linear and/or nonlinear equality constraints. The equality constraints are incorporated into the state estimation method by means of synthetic measurements in which the slowly varying variable is assumed to be observed.

Accordingly, one embodiment discloses a monitoring system for monitoring an operation of a vapor compression cycle. The monitoring system comprises a processor, and a memory having instructions stored thereon that, when executed by the processor, cause the monitoring system to collect digital representation of observed variables of the operation of the vapor compression cycle over multiple instances of time; execute a constrained ensemble Kalman smoother for each instance of time to estimate state variables of the vapor compression cycle for each instance of time, wherein the constrained ensemble Kalman smoother updates state variables over a sequence of time instances within a smoothing window by solving a series of constrained optimization problems formulated in a range of a covariance, for which constraints are enforced for every variable in the smoothing window for every instance of the constrained optimization problems, and output, based on the estimates of the state variables, estimates of variables of the vapor compression cycle at each instance of time.

Accordingly, another embodiment discloses a method for monitoring an operation of a vapor compression cycle. The method comprises collecting digital representations of observed variables of the operation of the vapor compression cycle over multiple instances of time; executing a constrained ensemble Kalman smoother for each instance of time to estimate state variables of the vapor compression cycle for each instance of time, wherein the constrained ensemble Kalman smoother updates state variables over a sequence of time instances within a smoothing window by solving a series of constrained optimization problems in a range of a covariance, for which constraints are enforced for every variable in the smoothing window for every instance of the constrained optimization problems, and outputting, based on the estimates of the state variables, estimates of variables of the vapor compression cycle at each instance of time.

Accordingly, yet another embodiment discloses a non-transitory computer-readable storage medium embodied thereon a program executable by a processor for performing a method for monitoring an operation of a vapor compression cycle. The method comprises collecting digital representations of observed variables of the operation of the vapor compression cycle over multiple instances of time; executing a constrained ensemble Kalman smoother for each instance of time to estimate state variables of the vapor compression cycle for each instance of time, wherein the constrained ensemble Kalman smoother updates state variables over a sequence of time instances within a smoothing window by solving a series of constrained optimization problems in a range of a covariance, for which constraints are enforced for every variable in the smoothing window for every instance of the constrained optimization problems, and outputting, based on the estimates of the state variables, estimates of variables of the vapor compression cycle at each instance of time.

BRIEF DESCRIPTION OF THE DRAWINGS

The presently disclosed embodiments will be further explained with reference to the attached drawings. The drawings shown are not necessarily to scale, with emphasis instead generally being placed upon illustrating the principles of the presently disclosed embodiments.

DETAILED DESCRIPTION

In the following description, for purposes of explanation, numerous specific details are set forth to provide a thorough understanding of the present disclosure. It will be apparent, however, to one skilled in the art that the present disclosure may be practiced without these specific details. In other instances, apparatuses and methods are shown in block diagram form only to avoid obscuring the present disclosure.

As used in this specification and claims, the terms "for example," "for instance" and "such as," and the verbs "comprising," "having," "including," and their other verb forms, when used in conjunction with a listing of one or more components or other items, are each to be construed as open ended, meaning that the listing is not to be considered as excluding other, additional components or items. The term "based on" means at least partially based on. Further, it is to be understood that the phraseology and terminology employed herein are for the purpose of the description and should not be regarded as limiting. Any heading utilized within this description is for convenience only and has no legal or limiting effect.

Heat pumps, air conditioners and refrigerators are examples of devices that move heat from one or more physical locations to other locations to achieve desirable thermal conditions at one or more of these locations. In some embodiments, the heat pumps employ a vapor compression cycle to move the heat. An operation of the vapor compression cycle may be described using thermofluid property variables, such as temperature, pressure, humidity, specific enthalpy, density, viscosity, and the like. It is desirable to operate the vapor compression cycle in a manner that satisfies various operational constraints, such as maintaining the thermofluid property variables below each of their respective maximum limits to prevent damage to the heat pump. Additionally, it is desirable to operate the vapor compression cycle such that the thermofluid property variables remain at their desirable set points, despite disturbances that may act on the vapor compression cycle.

Figure 1:
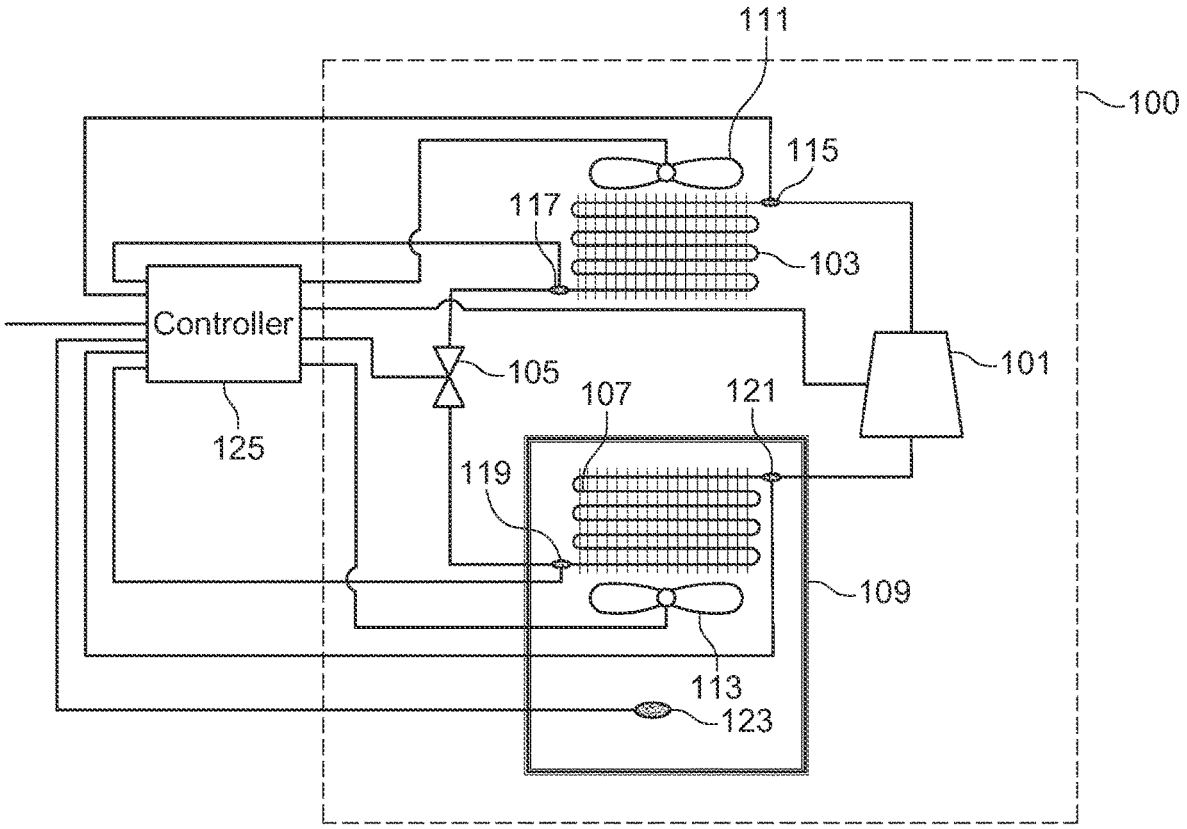
FIG. 1 illustrates a vapor compression cycle, according to an embodiment of the present disclosure.

FIG. 1 illustrates a vapor compression cycle 100, according to an embodiment of the present disclosure. The vapor compression cycle 100 includes a compressor 101, a condensing heat exchanger 103, an expansion valve 105, and an evaporating heat exchanger 107 located in a space 109. Heat transfer from the condensing heat exchanger 103 is promoted by use of a fan 111, while heat transfer from the evaporating heat exchanger 107 is promoted by use of a fan 113. The vapor compression cycle 100 may include variable actuators, such as a variable compressor speed, a variable expansion valve position, and variable fan speeds. There are many other alternate equipment architectures to which the present disclosure pertains with multiple heat exchangers, compressors, valves, and other components such as accumulators or reservoirs, pipes, and so forth, and the illustration of the vapor compression cycle 100 is not intended to limit the scope or application of the present disclosure to systems whatsoever.

In the vapor compression cycle 100, the compressor 101 compresses a low pressure, low temperature vapor-phase fluid (a refrigerant) to a high pressure, high temperature vapor state, after which it passes into the condensing heat exchanger 103. As the refrigerant passes through the condensing heat exchanger 103, the heat transfer promoted by the fan 111 causes the high-temperature, high pressure refrigerant to transfer its heat to ambient air, which is at a lower temperature. As the refrigerant transfers the heat to the ambient air, the refrigerant gradually condenses until the refrigerant is in a high pressure, low temperature liquid state. Further, the refrigerant leaves the condensing heat exchanger 103 and passes through the expansion valve 105, and expands to a low pressure boiling state from which it enters the evaporating heat exchanger 107. As air passing over the evaporating heat exchanger 107 is warmer than the refrigerant itself, the refrigerant gradually evaporates as it passes through the evaporating heat exchanger 107. The refrigerant leaving the evaporating heat exchanger 107 is at a low pressure, low temperature state. The low pressure, low temperature refrigerant re-enters the compressor 101 and the same cycle is repeated.

The vapor compression cycle 100 operates at a nominal set of input values for actuators, e.g., a speed of the compressor 101, a speed of the fan 111, a position of the expansion valve 105, a speed of the fan 113, and the like. It is desired or an objective that the vapor compression cycle 100 achieve performance metrics, for example, regulating variables such as a temperature or humidity in the space 109 or regulating process variables such as a temperature or a pressure at one or more points in the vapor compression cycle 100. To achieve such objectives, one or more sensors are installed at various locations in the vapor compression cycle 100 to monitor variables of interest. The variables of interest may include the temperature, the humidity, and/or the pressure. For example, sensors 115, 117, 119, and 121 are located at different locations. The sensors 115, 117, 119, and 121 monitor the temperature and/or the pressure at their respective locations. Alternatively or in addition, measurements of variables in the space 109, such as temperature or humidity, may also be obtained via sensors such as a sensor 123.

Information from the sensors 115, 117, 119, 121, and 123 is input to a controller 125 associated with the vapor compression cycle 100. Based on the information from the sensors 115, 117, 119, 121, and 123, the controller 125 may control an operation the vapor compression cycle 100. For example, based on the information from the sensors 115, 117, 119, 121, and 123, the controller 125 may change the input values of the actuators, e.g., the speed of the compressor 101, the speed of the fan 111, the position of the expansion valve 105, and the speed of the fan 113 to achieve desired performance metrics.

However, some variables of the operation of the vapor compression cycle 100 are difficult to measure. For example, an amount of the refrigerant in the vapor compression cycle 100, an amount of cooling energy or heating energy supplied to the space 109 by the vapor compression cycle 100, and the like, are difficult to measure. Estimates of these variables are useful for monitoring and controlling of the vapor compression cycle 100. For instance, based on amount of the refrigerant in the vapor compression cycle 100, a leakage of the refrigerant may be monitored.

Further, based on the estimate of the amount of cooling energy or heating energy supplied to the space 109, the controller 125 may adjust the operation of the vapor compression cycle 100, such as achieving specific values of the thermal energy delivered to the space 109, rather than solely regulating a temperature of the space 109.

Additionally, measurements of some variables (e.g., mass flow rate) are not cost effective due to high cost of some sensor types and difficulty in installing the sensors. The variables of the operation of the vapor compression cycle 100 that are observed or measured from the one or more sensors are referred to as observed variables and the variables that are unobserved or difficult to measure are referred to as unobserved variables. The observed variables may include measurements of one or more of a temperature and a pressure, at different locations in the vapor compression cycle 100. The unobserved variables may include the amount of refrigerant in the vapor compression cycle 100, thermal energy delivered by one or more heat exchangers of the vapor compression cycle 100, and a thermodynamic quality of the refrigerant flow at an inlet or outlet of one or more heat exchangers of the vapor compression cycle 100.

It is an object of some embodiments to estimate all or at least a majority of state variables of the vapor compression cycle 100. The state variables are defined as a set of those variables that describe a mathematical state of a system model of the vapor compression cycle 100, which can be used for predicting future behavior of a real vapor compression system. The state variables may include the unobserved and/or the observed variables of the vapor compression cycle 100. The state variables corresponding to the system model of the vapor compression cycle 100 may include thermodynamic properties of the refrigerant such as pressure, temperature, and specific enthalpy. Additionally, the state variables may include parameters of the system model which are to be estimated.

Additionally or alternatively, it is an object of some embodiments to estimate all or at least a majority of the state variables with a prescribed accuracy. Certain unobserved variables including refrigerant mass, heating or cooling capacity, and mass flow rate can be estimated from the state variables of the vapor compression cycle 100 using physical relationships among these variables. Therefore, the accuracy of the state estimates is vital in many applications for the vapor compression cycle 100, such as in performance monitoring or design. To achieve such objectives, some embodiments provide a monitoring system. The monitoring system is configured to estimate the unobserved variables of interest and monitor the operation of the vapor compression cycle 100.

Figure 2:
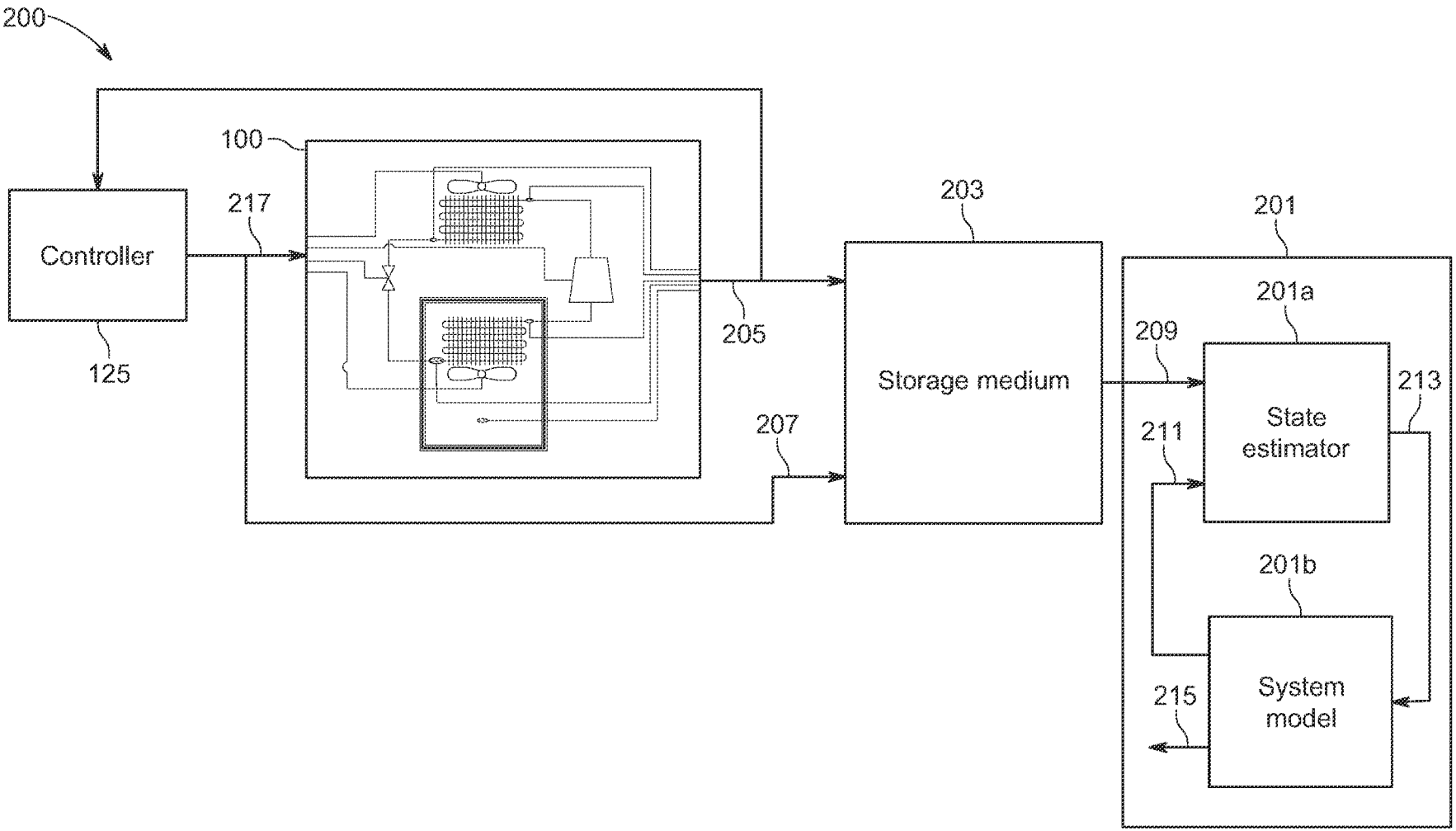
FIG. 2 shows a schematic of a system architecture including a monitoring system for estimating unobserved variables and monitoring an operation of the vapor compression cycle, according to some embodiments of the present disclosure.

FIG. 2 shows a schematic of a system architecture 200 including a monitoring system 201 for estimating the unobserved and/or observed variables and monitoring the operation of the vapor compression cycle 100, according to some embodiments of the present disclosure. The system architecture 200 includes the vapor compression cycle 100, the controller 125, the monitoring system 201, and a storage medium 203. Measurement data 205 from the sensors (e.g., the sensors 115, 117, 119, 121, and 123) installed in the vapor compression cycle 100 and control inputs 207 provided by the controller 125 are stored in the storage medium 203. Additionally, in some embodiments, other internal information associated with the controller 125, such as internal controller variables, discrete variables from control logic, or other information produced by the controller 125, may be stored in the storage medium 203.

Further, data 209 from the storage medium 203 is periodically provided to monitoring system 201, either at regular intervals or when there is an event that calls for the estimation of the unobserved and/or observed variables, for example, when a user requests for information related to the operation of the vapor compression cycle 100. In an embodiment, the data 209 may include digital representation of the observed variables of the operation of the vapor compression cycle over multiple instances of time. The monitoring system 201 may have its computational hardware co-located at the same geographical site where the vapor compression cycle 100 is located, or at a different location.

The monitoring system 201 includes a state estimator 201*a* and a system model 201*b*. The state estimator 201*a* is configured to compare the data 209 from the storage medium 203 with predictions 211 of the state variables from the system model 201*b*. Based on this comparison, the state estimator 201*b* computes state estimation corrections that compensates for a difference between the data 209 and the predictions 211. The corrected state estimates 213 are then provided to the system model 201*b*, which produces prediction of a behavior of the vapor compression cycle 100 over a time horizon of interest. Furthermore, the produced prediction is provided to the state estimator 201*a*, which generates further state corrections.

The behavior of the vapor compression cycle 100 is represented by the system model 201*b* that can describe its temporal evolution, $$\dot{x}=f(x,u,t,\theta)+\xi \tag{1a}$$

$$y=h(x,u,t,\theta)+\eta \tag{1b}$$

where $\xi$ and $\eta$ are normal variables $N(0,\Sigma)$ and $N(0,\Gamma)$. The system model 201*b* takes as input a set of control inputs u from the vapor compression cycle 100, including but not limited to measured actuator inputs 207 (e.g., compressor speeds, fan speeds) and disturbance inputs (e.g., ambient temperature or humidity), a set of parameters $\theta$ that characterize attributes of the vapor compression cycle 100, such as but not limited to geometries, performance variables such as heat transfer coefficients or frictional pressure drop coefficients, and a set of initial values for state variables x. From these inputs, the system model 201*b* estimates a set of outputs 215 $y=h(x,u,t,\theta)$. The set of outputs 215 may include variables of the vapor compression cycle, including variables that represent sensor measurements from the sensors (i.e., observed variables) and/or the unobserved variables of interest. The set of outputs 215 including the observed variables and the unobserved variables is an output of the monitoring system 201. The set of outputs 215 may indicate a behavior of the vapor compression cycle 100, thereby the monitoring system 201 may monitor the operation of the vapor compression cycle 100, based on the set of outputs 215.

In some embodiments, the set of outputs 215 and a set of user inputs which may include temperature or humidity set points or other objectives, such as minimizing power consumption or maximizing thermal comfort metrics, are input to the controller 125. Based on the output 215 and the set of user inputs, the controller 125 computes control inputs 217 for the vapor compression cycle 100, which includes one or more of compressor speeds, expansion valve positions, and fan speeds.

Some embodiments are based on a recognition that the state estimators, such as a Kalman-based estimator such as a Kalman filter or Kalman smoother, can increase the accuracy of estimation of the unobserved variables. The Kalman-based estimators use a series of measurements observed over time, that include statistical noise and other inaccuracies, to produce estimates of the unobserved and/or observed variables by estimating a joint probability distribution over the sate variables for each time frame. Some embodiments are based on a recognition that Kalman smoothers can generate more accurate predictions of the state variables than Kalman filters, as Kalman smoothers are non-causal and can more accurately describe spatial distribution of the variables of interest. Whereas Kalman filters are focused on applications in which state predictions are generated purely on basis of past data, the Kalman smoothers generate state estimates for a given point in time using data that both precedes and follows that point.

The system model 201*b* may be defined from a variety of contexts, including but not limited to an understanding of physics-based processes taking place in the vapor compression cycle 100, or from a data-driven approach such as machine learning. Some embodiments are based on the realization that the system model 201 must satify constraints that govern the behavior of the vapor compression cycle 100 to ensure correct operation of the system model 201*b* over future time instances.

Figure 3:
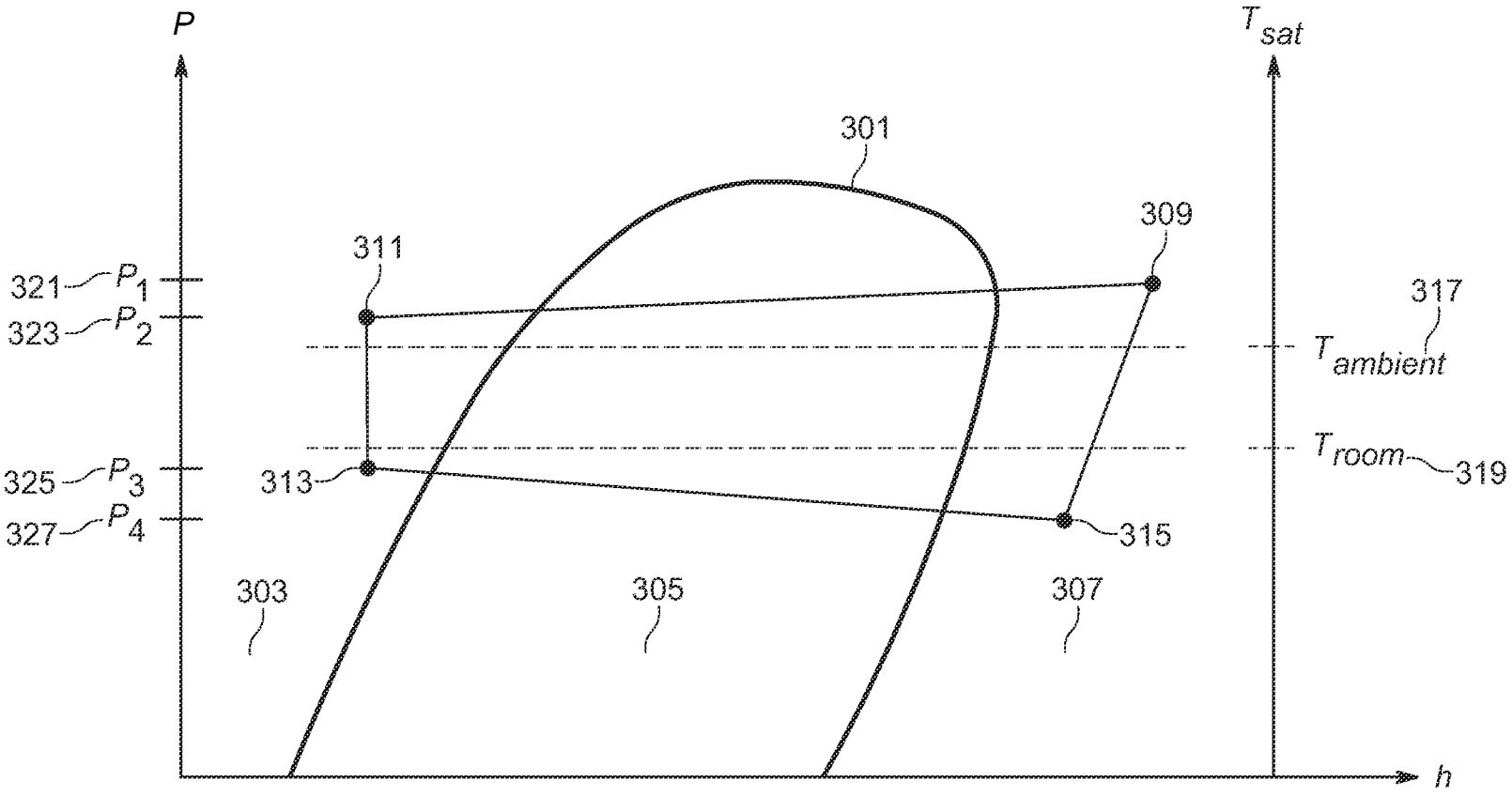
FIG. 3 illustrates constraints that must be satisfied by a system model, according to some embodiments of the present disclosure.

FIG. 3 illustrates the constraints that must be satisfied by the system model 201*b*, according to some embodiments of the present disclosure. Characteristics of the vapor compression cycle 100 are illustrated in coordinates of refrigerant pressure P and refrigerant specific enthalpy h. Axis $T_{sat}$ illustrates a saturation temperature of the refrigerant, which is a univariate function of the refrigerant pressure. A saturation curve 301 illustrates a boundary between a single-phase region and a two-phase region. A region 303 to left of the saturation curve 301 is a liquid region for the refrigerant, while a region which describes liquid/vapor mixtures, otherwise known as the two-phase region, is characterized by a region 305, and a vapor region is characterized by a region 307.

State points 309-315 are connected with lines that describe a steady-state operation of the vapor compression cycle 100. The state point 309 illustrates the high-pressure, high-temperature state of the refrigerant as it leaves the compressor 101, and the pressure is reduced as the refrigerant condenses while it travels through the condensing heat exchanger 103 to reach the high pressure, low temperature state point 311. After an isenthalpic expansion process, the refrigerant leaves the expansion valve 105 at a lower pressure 313, after which it travels through the evaporator heat exchanger 107 and the pressure is reduced further while the refrigerant heats up to reach the state point 315. The compressor 101 then compresses the refrigerant to return to the state point 309.

In plot of FIG. 3, a relationship between inlet temperatures of air flow through both the condensing or evaporating heat exchangers and the saturation temperature of the refrigerant travelling through those same heat exchangers may be observed. The saturation temperature is of particular relevance to the condensing or evaporating processes, specifically for pure refrigerants, because those processes are isothermal for many common refrigerants. A difference between a condensing temperature (corresponding to a line connecting 309 and 311 projected onto the saturation temperature axis) and an ambient temperature 317 has a significant effect on an amount of heat transferred from the refrigerant to an ambient environment, and a difference between an evaporating temperature (corresponding to a line connecting 313 and 315, again projected onto the saturation temperature axis) and a room temperature 319 has a significant effect on an amount of heat transferred from the room to the refrigerant.

Such a cycle of operation described with reference to FIG. 3 exhibits many constraints that must be satisfied by any model of the of the vapor compression cycle 100 (e.g., the system model 201*b*). For example, the refrigerant pressure must decrease in a direction of flow. This is evident in FIG. 3, as the pressure decreases from a compressor outlet 321 to a condenser outlet 323, to 325 at an evaporator inlet, to 327 at a compressor inlet. Because the refrigerant flows from high pressure to low pressure, maintaining a physics-based set of inequality relationships for the pressure changes is essential to correct operation of the model 201 of the of the vapor compression cycle 100. In addition, the refrigerant temperature $T_{cond}$ as it passes through the condensing heat exchanger at some location must be higher than the ambient temperature 317, while the refrigerant temperature $T_{evap}$ as it passes through the evaporating heat exchanger at some location must be lower than the room temperature 319.

Some embodiments are based on the recognition that the existence of these constraints can pose challenges to the operation of the state estimator 201*a*. Under standard formulations of the state estimators, there are no guarantees on the structure of the state corrections, especially given potential noise in the measurement data 205. The corrected state estimates 213 must satisfy the constraints to correctly represent the behavior of the vapor compression cycle 100. For example, a set of pressures in a vector of state variables must satisfy physics-based inequality constraints governing the direction of flow. In addition, a map of the state variables to a observation function must ensure that $T_{cond}>T_{ambient}$ and $T_{evap}>T_{room}$ for the model. Since such constraints represent fundamental assumptions in the construction and operation of the models of the vapor compression cycle 100, including physics-based models, corrected state estimates 213 that do not satisfy the constraints may cause the system model 201*b* to malfunction. Consequently, the system model 201*b* does not produce valid predictions during an interval after the corrected state estimates 213 are applied. To that end, there is a need for a state estimation process in which the corrected state estimates satisfy constraints.

Figure 4:
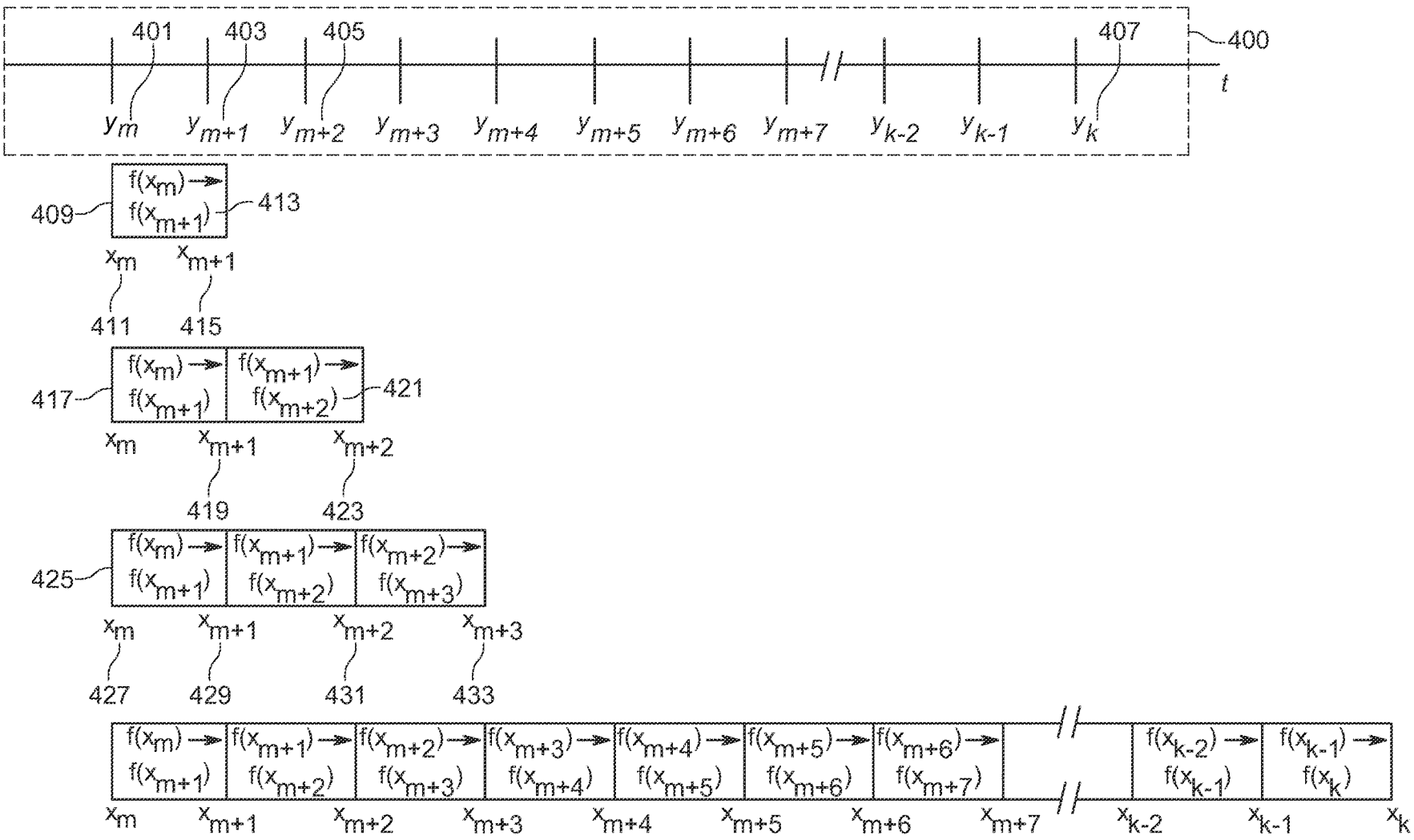
FIG. 4 shows a schematic of a state estimation process for a time series of data, according to some embodiments of the present disclosure.

FIG. 4 shows a schematic of a state estimation process for a time series of data, according to some embodiments of the present disclosure. Data 400 includes measurements 205 collected at (k−m+1) sample times, and are obtained by the state estimator 201*a* from the storage medium 203. The data 400 includes data collected at an initial time $y_m$ 401, a second time $y_{m+1}$ 403, a third time $y_{m+2}$ 405, and so forth up to a final time $y_k$ 407. The data $y_i$ collected at each sample time may include multiple measurements, so that each instance of $y_i$ represents a vector.

The state estimator 201*a* begins a first step 409 with an initial value 411 for the set of state variables x at time m as well as a model of the vapor compression cycle 100, which may include a set of differential equations describing the behavior of the vapor compression cycle 100. The model is solved forward 413 from time m to time m+1 to compute values of state variables $x_{m+1}$ 415 and values of the model predictions $h(x_{m+1})$. The state estimator 201*a* then uses the data $y_{m+1}$ 403 and the model predictions $h(x_{m+1})$ to compute a set of corrections to the state variables to obtain corrected state estimates.

In one embodiment, a probabilistic estimator, such as a Kalman filter or Kalman smoother, is used to obtain the corrected state estimates. For example, at second step 417, both the Kalman filter and the Kalman smoother first uses corrected state estimates $x_{m+1}$ 419 to solve the model forward 421 to compute new model predictions $h(x_{m+2})$. The Kalman filter only corrects state variables $x_{m+2}$ 423 using the data $y_{m+2}$, while the Kalman smoother uses the data $y_{m+2}$ to correct the state variables $x_{m+1}$ 419 and $x_{m+2}$ 423. The Kalman smoothers thereby use the measurement data (e.g., the data $y_{m+2}$) more thoroughly than the Kalman filters, as all of the measurement data is used to update all of the state estimates.

In third step 425, the state estimator 201*a* solves the model forward again to time m+3 to compute values of the state variables $x_{m+3}$ 433, and then corrects all of the state variables $x_m$ 427, $x_{m+1}$ 429, $x_{m+2}$ 431, and $x_{m+3}$ 433, using the data $y_{m+3}$. This process repeates until all of the data up to the last data available from the storage memory $y_k$ is processed.

The corrected state estimates such as $x_{m+1}$ 415 or $x_{m+2}$ 423, must satisfy the constraints on the model for the model predictions to be generated over the following time instants. Enforcing the constraints on the corrected state estimates at every time instant, rather than only at a current time instant, guarantees that all of the constraints are met for all of the state variables. Some embodiments are based on the realization that an ensemble Kalman smoother that enforces the constraints for every point can be formulated.

Some variables, including refrigerant mass in the vapor compression cycle, vary slowly with time and can be assumed to be constant over relatively shorter periods over which the state estimation is performed. This information about the slowly varying variables can be represented by linear and/or nonlinear equality constraints. The equality constraints are incorporated into the state estimation process by means of synthetic measurements in which the slowly varying variable is assumed to be observed. The synthetic measurements are artificially generated by sampling a Gaussian distribution which represents a prior estimate of the variable, where a variance of the Gaussian distribution representing uncertainty in the state estimate corresponds to a noise variance of the synthetic measurements. In some embodiments, the measurement data 400 $y_i$ may therefore comprise real measurement data 205 as well as the synthetic measurements $y_i^{syn}$. The synthetic measurements $y_i^{syn}$ are generated from a known normal distribution $N(\overline{y}_i^{syn},Y)$ which may be available from physics-based domain expertise, and/or from the state estimates obtained using filtering or smoothing analysis performed in the past.

From a mathematical perspective and with reference to Equation 1, an objective of state estimation is to characterize a probability density function p(x|y) given data y(t), which can be described as determining the most likely trajectories of the state variables given a set of measured data y. In a case where $f$ and h are linear, the value of x that maximizes the likelihood can be calculated as a solution of a linear quadratic estimator, which is known as a linear Kalman filter when used to provide updates for the state estimates as the measurements are being collected online, or a linear Kalman smoother when used in a non-causal setting to process data that has been collected previously.

Some embodiments are based on the recognition that standard implementations of the Kalman-based estimators, including the Kalman smoothers, do not work well with the large numbers of state variables found in models of vapor compression cycles, and that the structure of a Kalman-based estimator must be adjusted to handle the estimation of a large number of state variables. For example, an ensemble Kalman filter is a recursive filter suitable for such problems. Moreover, some embodiments are based on the recognition that the application of ensemble Kalman filters to smoothing problems results in scale-related challenges when applied to long smoothing windows for large systems. One embodiment of the present disclosure thus defines a state estimation method using an ensemble Kalman smoother that implements a coordinate transformation so that the update is performed in a covariance range, rather than in a space of original state variables, so that the size of estimation problem is only dependent upon the number of members of the ensemble. This makes the generation of state estimates over long time series of data computationally tractable and can improve accuracy of these estimates by using information from an entire duration of the smoothing window.

In an embodiment, rather than constructing a single state estimate, the ensemble Kalman filter methods start with an initial set or ensemble of discrete state samples that have been stochastically perturbed, and evolve the state estimates over time. This ensemble of states can be represented as $$X_k^+=[x_k^{(1)+}x_k^{(2)+}\ldots x_k^{(M)+}]\in\mathbb{R}^{n\times M} \tag{2}$$

where an $i^{th}$ sample of state vector at time k after the state has been corrected by a current set of measurements available at time k is represented as $x_k^{(i)+}$, and there are M members of the ensemble. In a manner analogous to (2), the ensemble of states at time k after the state has been corrected by set of measurements available at time k−1 is represented as $X_k^- = [x_k^{(1)-} x_k^{(2)-} \ldots x_k^{(M)-}]$.

Representation (2) allows the covariance matrix to be calculated directly from the state estimates via $$P_k^- = \frac{1}{M-1} \tilde{X}_k^- (\tilde{X}_k^-)^T \tag{3}$$

where a matrix of deviations from an ensemble mean $\hat{x}_k^-$ is defined as $$\tilde{X}_k^- [(i_k^{(1)-} - \hat{x}_k^-)(x_k^{(2)-} - \hat{x}_k^-) \ldots (x_k^{(M)-} - \hat{x}_k^-)] \tag{4}$$

A stochastic ensemble Kalman filter takes as input a set of measurements $y_k$ and a set of predictions $X_k^-$ that forecast the model dynamics using previous state estimates and generates a corrected ensemble of states $x_k^{(i)+}$, e.g., $$x_k^{(i)+} = x_k^{(i)-} + P_k^- H_k^T (H_k P_k^- H_k^T + R_k)^{-1} (H_k x_k^{(i)-} - y_k - \eta_k^{(i)}) \tag{5}$$

with a set of stochastic perturbations $\eta_k^{(i)} \sim N(0, R_k)$. The representation in (5) utilizes a linear model for sensor measurements, i.e. $y_k = H_k x_k - \eta_k$. It is possible that some embodiments may utilize a nonlinear model for the sensor measurements, as when the synthetic measurements are utilized to incorporate the equality constraints corresponding to the slowly varying variables. This ensemble of corrected state vectors (5) is then used to forecast the state variables at the next measurement time k+1, e.g., $$x_{k+1}^{(i)-} = f_k(x_k^{(i)+}) + w_k^{(i)}. \tag{6}$$

Such closed-form set of recursive equations can be shown to compute an optimal estimate of the state variables under the assumptions that the model (6) is linear and the noise variables $w_k^{(i)}$ and $\eta_k^{(i)}$ are normally distributed. It can also be shown that the recursive equations equivalently compute the state update as a minimization of $$x_k^{(i)+} = \underset{x_k}{\operatorname{argmin}} J_k^{(i)}(x), \tag{7}$$

where a cost function $J_k^i(x_k)$ is defined as $$J_k^{(i)}(x_k) = \|x_k - x_k^{(i)-}\|^2_{(P_k^-)^{-1}} + \|y_k + \eta_k^{(i)} - H_k x_k\|^2_{R_k^{-1}}. \tag{8}$$

By formulating Kalman filtering problem as an optimization problem, it becomes possible to take advantage of machinery of modem optimization methods, including enforcement of the constraints on optimization variables.

Similar approaches can be used to formulate an unconstrained ensemble Kalman smoother problem. Each ensemble member can be formulated as an augmented state vector from time m to time k $$x_{m:k}^{(i)+} = \begin{bmatrix} x_m^{(i)+} \\ x_{m+1}^{(i)+} \\ \vdots \\ x_k^{(i)+} \end{bmatrix} \tag{9}$$

and an ensemble of states can be thus written as $$X_{m:k}^{+} = \begin{bmatrix} X_m^{+} \\ X_{m+1}^{+} \\ \vdots \\ X_k^{+} \end{bmatrix} \tag{10}$$

The representation of other variables in the unconstrained ensemble Kalman smoother problem is analogous to those of the ensemble Kalman filter. The optimal state estimates for the unconstrained ensemble Kalman smoother can therefore be derived as a solution of the following optimization problem, $$x_{m:k}^{(i)+} = \underset{x_{m:k}}{\operatorname{argmin}} J_{m:k}^{(i)}(x_{m:k}) \text{ where} \tag{11}$$

$$J_{m:k}^{(i)}(x_{m:k}) = \|x_{m:k} - x_{m:k}^{(i)-}\|^2_{(P_{m:k}^-)^{-1}} + \|y_k + \eta_k^{(i)} - H_{m:k} x_{m:k}\|^2_{R_k^{-1}},$$

and a matrix operator $H_{m:k}$ maps an augmented state vector to the sensor measurements at time k. Equation (11) represents the ensemble Kalman smoother as an unconstrained optimization problem. The formulation of the ensemble Kalman smoother as an optimization problem allows enforcement of the constraints. Additionally, as the optimization problem represents a quadratic program, it can be solved with readily available software that is designed to solve quadratic problems rather than requiring that a closed-form recursion is implemented to solve the optimization problem.

Figure 5:
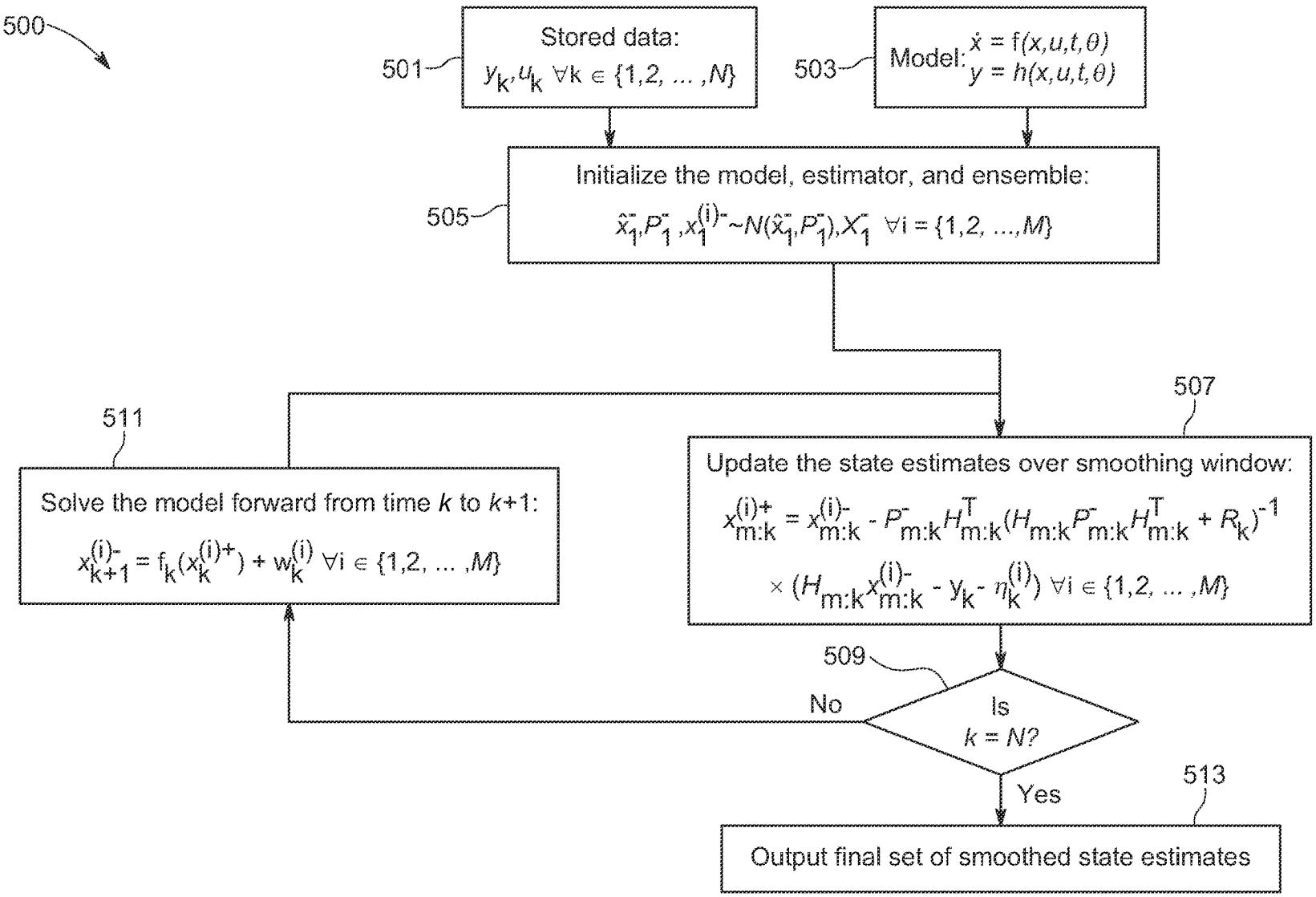
FIG. 5 shows a block diagram of a method for estimation of state variables using an unconstrained ensemble Kalman smoother, according to some embodiments of the present disclosure.

FIG. 5 shows a block diagram of a method 500 for estimation of the state variables using the unconstrained ensemble Kalman smoother, according to some embodiments of the present disclosure. The method 500 is formulated with a closed-form expression that represents a solution of the optimization problem of Equation 11.

The method 500 begins with data 501 from the operation of the vapor compression cycle 100 and a model 503 of the vapor compression cycle 100. The data 501 includes a set of inputs u and measurements y from the sensors installed in the vapor compression cycle 100. According to an embodiment, the model 503 of the vapor compression cycle 100 describes both evolution of the state variables via a function f and the measurements as a function of the state variables via a second function h which could be potentially a nonlinear function. For a description of method 500, a linear measurement function corresponding to (5) is assumed in block 507.

At block 505, the data 501 and the model 503 are used to initialize the unconstrained ensemble Kalman smoother with an initial ensemble of states $x_1^{(i)-}$ of size M. One approach for initializing is to determine a consistent initialization of the model 503 given a user-specified set of initial conditions, and then perturb initial states with a stochastic set of perturbations with an estimated model covariance.

At block 507, state estimations are updated over a smoothing window for every measurement in the smoothing window to produce corrected state estimates, after which the state variables are forecast to the measurement time, starting from the first data point in the smoothing window and proceeding to the last data point in the smoothing window.

While there may be N data points available, either all N data points may be used or a smaller set may be used in the smoothing window. For example, initially, a corrected state estimate at first measurement time k=1 is calculated, and then, at block 509, it is checked if the measurement time k=1 is a time instant of the last data point to determine smoothing window end. Since the measurement time k=1 is not equal to a length of the smoothing window, at block 511, nonlinear model f is solved forward from the first to the second measurement time k=2, and then the state variables are once again corrected (or updated) to account for the measurements at time k=2.

At time k=2, state corrections are applied to both the state estimates at times k=1 and k=2. This ensures that the state estimates at time k=1 accounts for information provided at time k=2. In such an iteration, length of data over which the state estimates will gradually increase as additional data is incorporated until all of the N data points are incorporated, and all of the state variables will be continually updated to reflect new information provided by the data points that are being added to the growing smoothing window. Increasing length of the smoothing window as more data points are incorporated may pose serious computational challenges such as prohibitive memory requirements and computation time.

To this end, in some embodiments length of a smoothing window, i.e. number of data points l=k−m+1 in a smoothing window may be fixed to be a constant after sufficient number of data points are incorporated in corrected state estimates, so that data points available at times prior to m are not considered in the update step 507.

Once each data point is processed, at block 513, a final set of smoothed state estimates is output. The final set of smoothed state estimates includes the unobserved variables of the operation of the vapor compression cycle 100.

According to an embodiment, formulating the ensemble Kalman smoother as an optimization problem enables enforcement of the constraints. The optimal state estimate satisfying physical constraints of vapor compression cycle 100 can be derived by extending the unconstrained ensemble Kalman smoother from Equation (11) as a solution of the following optimization problem, $$x_{m:k}^{(i)+} = \underset{x_{m:k}}{\operatorname{argmin}}\, J_{m:k}^{(i)}(x_{m:k}) \text{ subject to} \tag{12a}$$

$$A_{m:k}x_{m:k} \le 0, \text{ where} \tag{12b}$$

$$J_{m:k}^{(i)}(x_{m:k}) = \left\|x_{m:k} - x_{m:k}^{(i)-}\right\|^2_{(P_{m:k}^-)^{-1}} + \left\|y_k + \eta_k^{(i)} - H_{m:k}x_{m:k}\right\|^2_{R_k^{-1}} \tag{12c}$$

With an appropriately defined matrix operator $A_{m:k}$, Equation (12b) represents the physical constraints that must be satisfied by the corrected state estimates. Alternatively or additionally, a constrained optimization problem (12) may include nonlinear and/or equality constraints on the augmented state variable $x_{m:k}$.

While the above formulation can successfully determine the optimal state estimates, the fact that the size of the optimization problem grows dramatically as the amount of data and the length of smoothing window increases can render the problem computationally intractable. This problem can be addressed by examining Equation (4) for the ensemble Kalman filter, for which the state correction equation can be of the form $$x_k^{(i)+} = x_k^{(i)-} + P_k^- b \tag{13}$$

For some value of b, the difference $x_k^{(i)+} - x_k^{(i)-}$ lies in the range of the covariance matrix $\mathbb{R}(P_k^-)$. By reformulating the optimization problem in this space, the size of the optimization problem will only be as large as the number of members of the ensemble.

The optimization problem can thus be reformulated in the range of the covariance matrix for the ensemble Kalman smoother by defining optimal correction to an augmented sample as $$v_{m:k}^{(i)*} = x_{m:k}^{(i)+} - x_{m:k}^{(i)-} \tag{14}$$

This correction $v_{m:k}^{(i)*}$ lies in the range of the covariance matrix, e.g., $v_{m:k}^{(i)*} \in \mathbb{R}(P_{m:k}^-)$.

With this reformulation of the optimization problem in the range of the covariance matrix, the optimization problem solved by the ensemble Kalman smoother can be rewritten in the covariance range with variable substitution $v_{m:k} = x_{m:k} - x_{m:k}^{(i)-}$ $$v_{m:k}^{(i)*} = \underset{v_{m:k}}{\operatorname{argmin}}\, \bar{J}_{m:k}^{(i)}(v_{m:k}), \text{ subject to} \tag{15a}$$

$$A_{m:k}v_{m:k} + A_{m:k}x_{m:k}^{(i)-} \le 0, \tag{15b}$$

where a loss function $\bar{J}_{m:k}^{(i)}(v_{m:k})$ is defined as $$\bar{J}_{m:k}^{(i)}(v_{m:k}) = \|v_{m:k}\|^2_{(P_{m:k}^-)^{-1}} + \left\|\tilde{y}_k^{(i)} - H_{m:k}v_{m:k}\right\|^2_{R_k^{-1}} \tag{15c}$$

where the substitution $$\tilde{y}_k^{(i)} = y_k + \eta_k^{(i)} - H_{m:k}x_{m:k}^{(i)-} \tag{16}$$

is made for the sake of clarity.

As $v_{m:k}$ is in the range of the covariance matrix $P_{m:k}^-$, a change of variables is constructed $$v_{m:k} = P_{m:k}^- z_{m:k} \tag{17}$$

that enables the first term in J to be reformulated as $$\|v_{m:k}\|_{(P_{m:k}^-)^{-1}} = \frac{1}{M-1}\|r\|^2, \text{ where} \tag{18a}$$

$$r = (\tilde{X}_{m:k}^-)^T z_{m:k} \in \mathbb{R}^M. \tag{18b}$$

The change of variables from $x_{m:k}$ to r reduces the dimension of the optimization variable from $\mathbb{R}^{(k-m+1)n}$ to $\mathbb{R}^M$. Using such variable substitutions, the optimization problem can be rewritten in terms of a new optimization variable r, $$r^{(i)*} = \underset{r}{\operatorname{argmin}}\, r^T B_2 r - 2b^T r \text{ subject to} \tag{19a}$$

$$A_{m:k}(B_1 r + x_{m:k}^{(i)-}) \le 0, \text{ where} \tag{19b}$$

$$B_2 = \frac{1}{M-1}I + \frac{1}{(M-1)^2}(H_{m:k}\tilde{X}_{m:k}^-)^T R^{-1} H_{m:k}\tilde{X}_{m:k}^- \tag{19c}$$

$$b^T = \frac{2}{M-1}\left[(\tilde{y}_k^{(i)})^T R^{-1} H_{m:k}\tilde{X}_{m:k}^-\right] \tag{19d}$$

$$B_1 = \frac{1}{M-1}\tilde{X}_{m:k}^- \tag{19e}$$

Once an optimal value of $r^{(i)*}$ is determined, the updated $i^{th}$ sample is given by inverse transformation $$x_{m:k}^{(i)+} = x_{m:k}^{(i)-} + B_1 r^{(i)*}. \tag{20}$$

When no constraints are active, the optimization problem (19a) is equivalent to problem (11a), but the optimization problem (19a) makes the problem computationally feasible for long smoothing windows. As a result, the performance of the vapor compression cycle 100 can be analyzed over longer smoothing windows than would otherwise be possible.

Equations (19) and (20) represent the constrained ensemble Kalman smoother as a constrained optimization problem in the range of the covariance. Additionally, constrained ensemble Kalman smoother is a quadratic program, which can be solved with readily available software that is designed to solve the quadratic programs.

Figure 6:
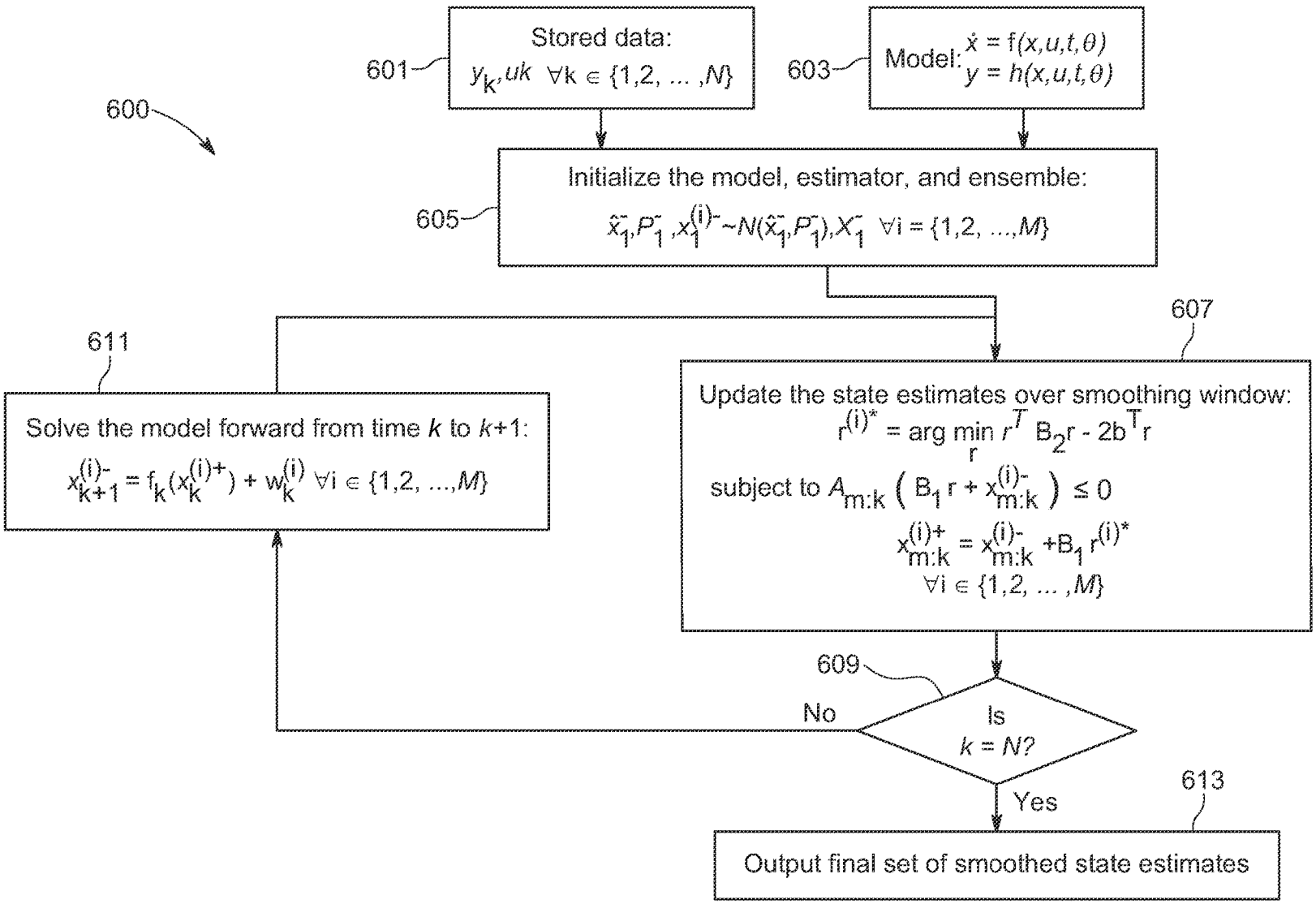
FIG. 6 shows a block diagram of a method for estimation of the state variables using a constrained ensemble Kalman smoother, according to some embodiments of the present disclosure.

FIG. 6 shows a block diagram of a method 600 for estimation of the state variables using the constrained ensemble Kalman smoother formulated in the range of the covariance, according to some embodiments of the present disclosure.

The method 600 begins with data 601 from the operation of the vapor compression cycle 100 and a model 603 of the vapor compression cycle 100. The data 601 includes a set of inputs u and measurements y from the sensors installed in the vapor compression cycle 100. According to an embodiment, the model 603 of the vapor compression cycle 100 describes both evolution of the state variables via a function $f$ and the measurements as a function of the state variables via a second function h which may be potentially a nonlinear function. For a description of method 600, a linear measurement function corresponding to (16) is assumed in block 607.

At block 605, the data 601 and the model 603 are used to initialize the unconstrained ensemble Kalman smoother with an initial ensemble of states $x_1^{(i)-}$ of size M. One approach for initializing the unconstrained ensemble Kalman smoother is to determine a consistent initialization of the model 603 given a user-specified set of initial conditions, and then perturb initial states with a stochastic set of perturbations with an estimated model covariance.

At block 607, the state variables that are transformed into the range of the covariance $r^{(i)*}$ are updated over the smoothing window for every measurement in data 601 by solving the constrained optimization problem. The transformed corrections are then transformed back into the coordinate system of original state variables to obtain corrected augmented state estimates. Although this embodiment of the constrained smoothing method 600 is not constructed for real-time use in the monitoring system 201, the solution of the constrained optimization problem in block 607 for every sample at each available data point may be computationally expensive. To this end, in some embodiments, the update step in block 607 can be replaced with a two-stage process, wherein in a first stage, the update is performed without constraints similar to block 507. After this update is applied, in a second stage, the constrained optimization problem in block 607 is solved only if the corrected augmented state estimates obtained in the first stage violate the constraints. The second stage is skipped if the constraints are satisfied after the corrections in the first stage.

While there may be N data points available, either all N data points may be used or a smaller set may be used in the smoothing window. For example, the state updates in the coordinate system of the range of the covariance at the first measurement time k=1 are calculated while applying constraints and then transformed back into the coordinate system of the original state variables.

At block 609, it is checked if the measurement time k=1 is the time instant of the last data point if the end of the available data has been reached. Since the measurement time k=1 is not equal to N, at block 611, the nonlinear model $f$ is then solved forward from the first to the second measurement time k=2, and then the state variables are once again updated to account for the measurements at time k=2.

At time k=2, state corrections are applied to the state estimates at both times k=1 and k=2 and the constraints are enforced at both times k=1 and k=2. This ensures that the state estimates at time k=1 account for the measurements at time k=2 and that the constraints will be satisfied at both times. In such an iteration, the length of data over which the state estimates will gradually increase as additional data is incorporated until all of the N data points are incorporated, and all of the state variables will be continually updated to reflect the new information provided by the data points that are sequentially added to the growing smoothing window. Increases in the length of the smoothing window as more data points are incorporated may pose serious computational challenges such as prohibitive memory requirements and computation time.

To this end, the length of a smoothing window, i.e., number of data points l=k−m+1 in a smoothing window may be fixed to be a constant after sufficient number of data points are incorporated in the corrected state estimates in some embodiments, so that the data points available at times prior to m are not considered in the update step 607. Once each data point is processed, at block 613, a final set of smoothed state estimates is output. The final set of smoothed state estimates include states of the unobserved variables of the operation of the vapor compression cycle 100.

The states of the unobserved variables may be used to monitor the operation of the vapor compression cycle 100. For example, the unobserved variables may include the amount of the refrigerant in the vapor compression cycle 100. Based on the amount of the refrigerant in the vapor compression cycle 100, the monitoring system 201 may monitor or detect a leakage of the refrigerant, as described below in FIG. 7.

Figure 7:
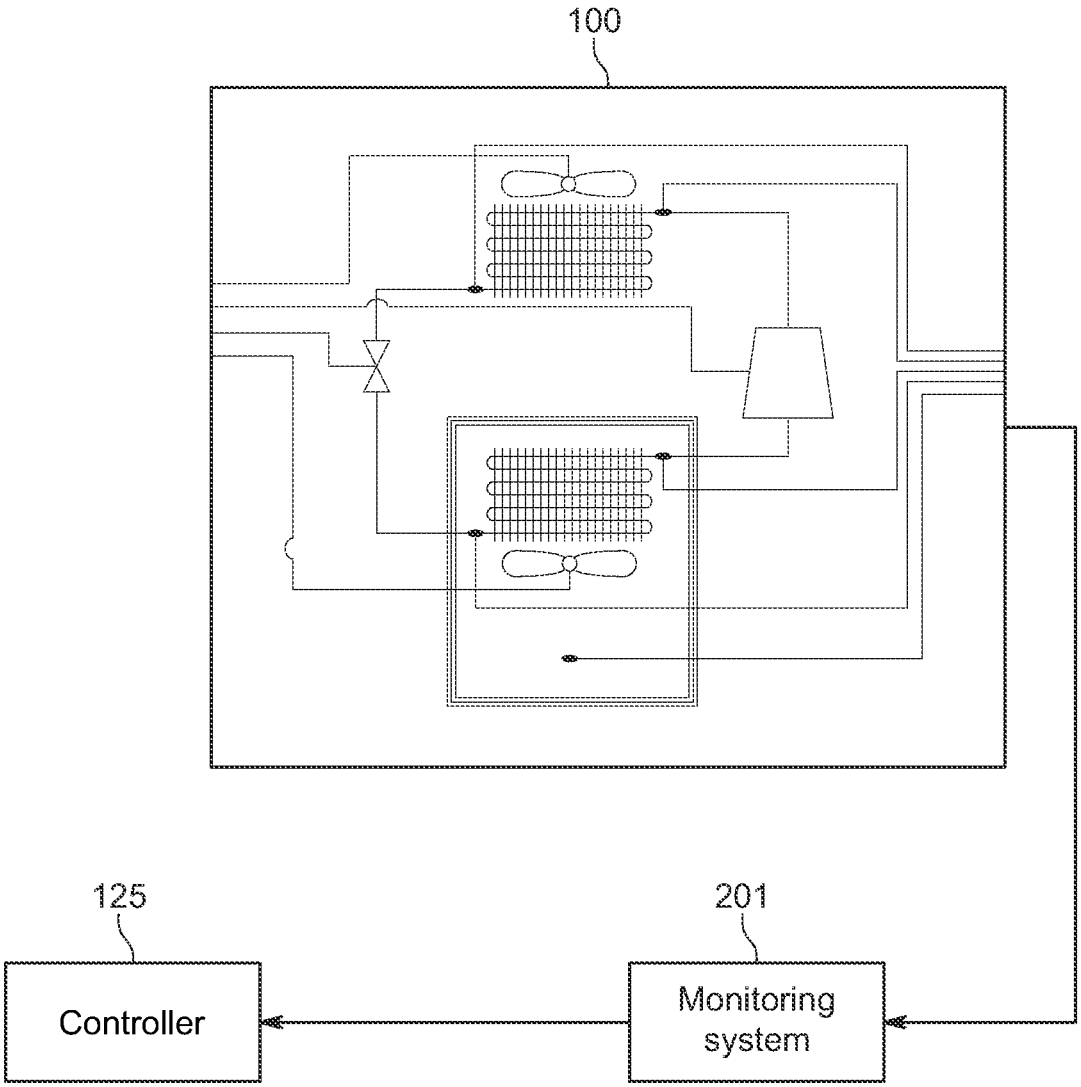
FIG. 7 shows a schematic for detection of a leakage of refrigerant by the monitoring system, according to some embodiments of the present disclosure.

FIG. 7 shows a schematic for detection of the leakage of the refrigerant by the monitoring system 201, according to some embodiments of the present disclosure. The monitoring system 201 receives measurement data from the sensors installed in the vapor compression cycle 100 and, according to some embodiments, the monitoring system 201 executes the constrained ensemble Kalman smoother for each instance of time to estimate the amount of the refrigerant in the vapor compression cycle 100.

Further, the monitoring system 201 compares the estimated amount of the refrigerant with a threshold or a desired amount of refrigerant that must be present in the vapor compression cycle 100. If the estimated amount of the refrigerant is less than the threshold, then it is inferred that there exists a leakage of the refrigerant. The monitoring system 201 transmits leakage data indicating the leakage of the refrigerant to the controller 125. Further, upon receiving the leakage data, the controller 125 activates an alert, such as a notification or an alarm, indicating the leakage of the refrigerant to a user.

Alternatively, in such an embodiment of leakage detection, the partial differential equations describing behavior of the heat exchangers are discretized into finite volumes, and state variables of such heat exchanger models include pressure $P_i$ and specific enthalpy $h_i$ for each volume i. In addition, parameters of a cycle model θ include volumes $V_i$ of each of the finite volumes. Such a model enables a density $\rho_i$ of the refrigerant in each of these volumes to be calculated as a function of the state variables $\rho_i(P_i,h_i)$, and a mass in each of these volumes can also be calculated as $M_i=\rho_i V_i$, by the monitoring system 201. The refrigerant masses can be summed across all of the volumes in the cycle model to compute the total refrigerant mass. The total refrigerant mass or variations thereof can be reported to the user via the monitoring system 201.

Additionally, in some embodiments, the states of the unobserved variables may be submitted to the controller 125. Based on the states of the unobserved variables, the controller 125 controls the operation of the vapor compression cycle. For example, the unobserved variables may include thermal energy delivered by one or more heat exchangers of the vapor compression cycle 100 (such as the condensing heat exchanger 103 and the evaporating heat exchanger 107). Based on the thermal energy delivered by the one or more heat exchangers of the vapor compression cycle 100, the controller 125 may change the operation of the vapor compression cycle 100, as described below in FIG. 8.

Figure 8:
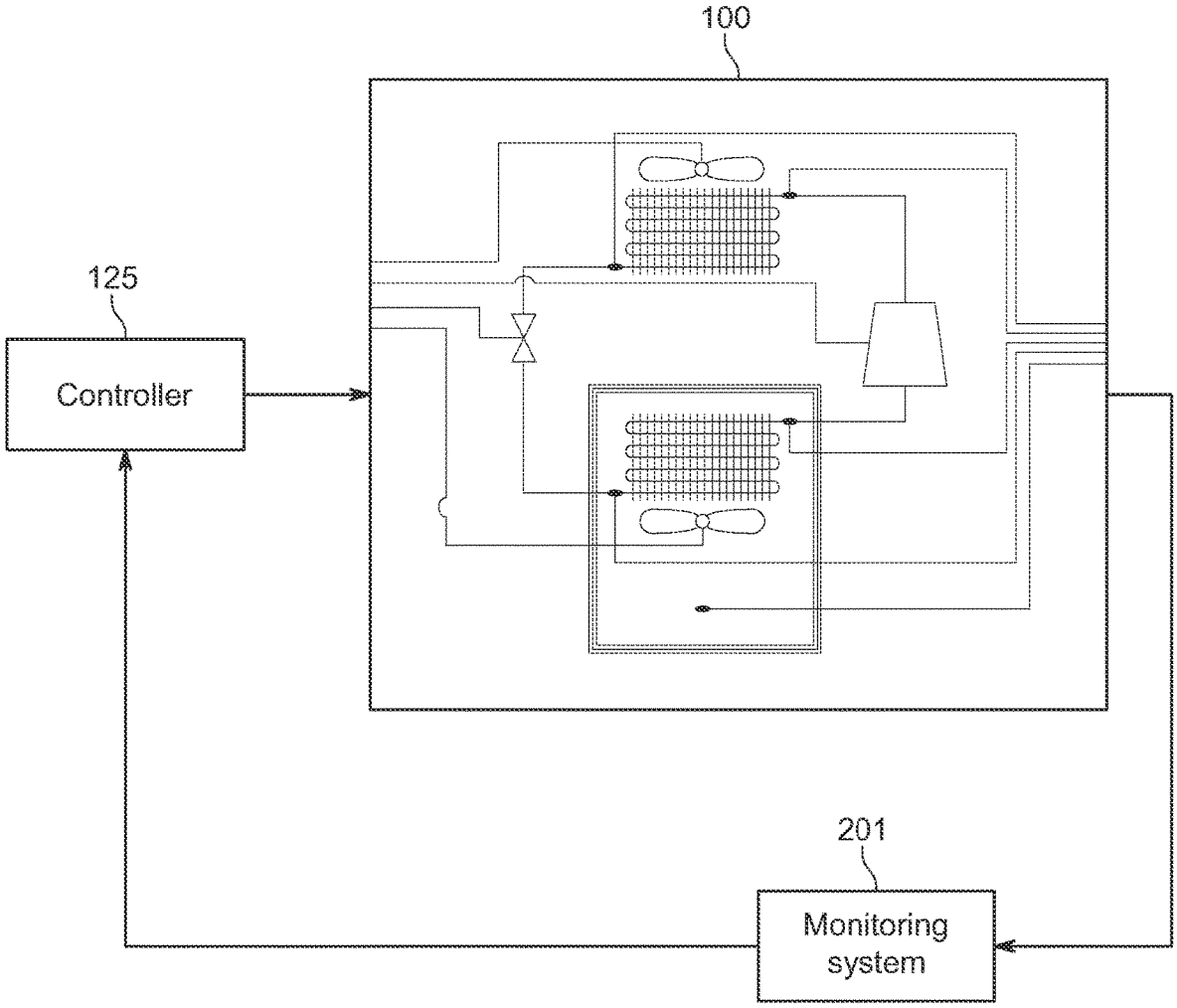
FIG. 8 shows a schematic for estimating thermal energy delivered by one or more heat exchangers of the vapor compression cycle and controlling the operation of the vapor compression cycle, according to some embodiments of the present disclosure.

FIG. 8 shows a schematic for estimating the thermal energy delivered by the one or more heat exchangers of the vapor compression cycle 100 and controlling the operation of the vapor compression cycle 100, according to some embodiments of the present disclosure. The monitoring system 201 receives the measurement data from the sensors installed in the vapor compression cycle 100 and, according to some embodiments, the monitoring system 201 executes the constrained ensemble Kalman smoother to estimate the thermal energy delivered by the one or more heat exchangers of the vapor compression cycle 100. The estimated thermal energy is input to the controller 125. Based on the estimated thermal energy, the controller 125 adjusts the behavior of the vapor compression cycle 100 according to user specifications and other equipment-based considerations.

Additionally or alternatively, in some embodiments, the monitoring system 201 executes the constrained ensemble Kalman smoother to estimate a thermodynamic quality of the refrigerant flow at either an inlet or outlet of the one or more heat exchangers. A thermodynamic quality $x_q$ for a mixture of liquid and gas is defined as $$x_q = \frac{h - h_{bub}}{h_{dew} - h_{bub}}$$

where h is specific enthalpy of the refrigerant at a point, $h_{bub}(P)$ is specific enthalpy of the refrigerant at bubble line, and $h_{dew}(P)$ is specific enthalpy of the refrigerant at dew line. The thermodynamic quality is a particularly informative quantity when considering vapor compression cycles because the vapor compression cycles transfer heat most efficiently when the thermodynamic quality is near unity at the outlet of the heat exchanger. The thermodynamic quality is difficult to measure directly. However, according to some embodiments, the monitoring system 201 executes the constrained ensemble Kalman smoother to estimate the thermodynamic quality of the refrigerant flow at either the inlet or the outlet of the one or more heat exchangers.

Some embodiments are based on the realization that a part or whole of the data stored in the storage medium 203 may be stored using cloud computing resources, and, in addition, the monitoring system 201 may be implemented on a remote server. Such an embodiment is described in FIG. 9.

Figure 9:
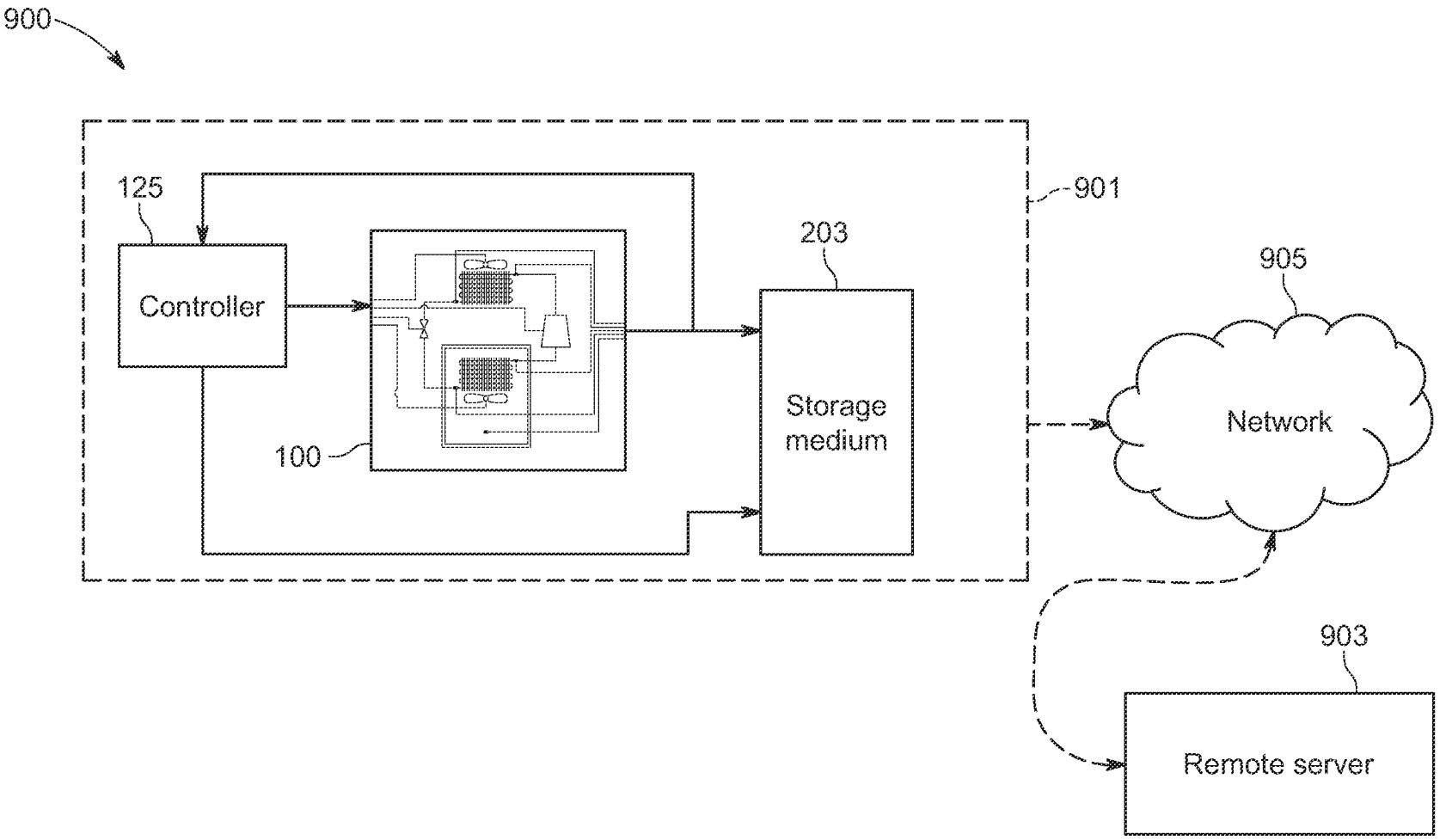
FIG. 9 shows a schematic of a cloud-based architecture, where the monitoring system is implemented on a remote server, according to some embodiments of the present disclosure.

FIG. 9 shows a schematic of a cloud-based architecture 900, where the monitoring system 201 is implemented on a remote server 903, according to some embodiments of the present disclosure. The vapor compression cycle 100, the controller 125, and the storage medium 203 is considered to be a system 901. The system 901 is in communication with the remote server 903 (also referred to as a cloud computing system) via a network 905. In this case, a size of the storage medium 203 may vary and, additionally or alternatively, may or may not be present, depending on ability and/or reliability of the remote server 903 to access data from the vapor compression cycle 100.

The system 901 is configured to transmit a part or whole of data (e.g., the digital representation of the observed variables) to the remote server 903 for storage, rather than maintaining the data in the storage medium 203 co-located with the vapor compression cycle 100. The data stored in the remote server 903 can then be downloaded by a separate set of computational resources. Further, since the monitoring system 201 is implemented on the remote server 903, the remote server 903 may estimate the states of the unobserved variables. The estimated states of the unobserved variables may then be transmitted to the system 901, in particular to the controller 125. Based on the unobserved variables, the controller 125 may control the operation of the vapor compression cycle 100.

The cloud-based architecture 900 is advantageous. For example, only limited computational resources are required to be co-located with the vapor compression cycle 100, and appropriate computational resources can be easily adjusted and scaled in the remote server 903, i.e., cloud. In addition, both the data and the estimates of the states of unobserved variables can be simultaneously used in a variety of different contexts, including but not limited to equipment service or maintenance scheduling, or use in development of next-generation systems. According to some embodiments, the estimates of the states of unobserved variables may indicate a need for equipment maintenance that is not readily apparent from measured data. The cloud-based architecture 900 may make such information readily and asynchronously available to service companies so that they can automatically follow-up with a user and schedule a maintenance call. In addition, the information provided to the service company enables use of precise diagnostics and service tools. Moreover, parameters of the system model 201*b* implemented on remote server 903 can be updated periodically based on the estimated unobserved variables and/or maintenance history to mimic the physical vapor compression cycle 100 as closely as possible. For example, a failed component (e.g. compressor, fan) of the vapor compression cycle 100 may be replaced during maintenance service by an independent contractor. The specification information of the newly installed component can be used to update the model 201*b* on remote server 903.

Additionally or alternatively, the cloud-based architecture 900 is useful in remote control and coordination of multiple vapor compression cycles. For example, multiple vapor compression cycles are often used to condition a given space. The multiple vapor compression cycles interact because they all affect temperature of the space. Estimates of an amount of thermal energy delivered by each individual vapor compression cycle may be remotely provided to each of the other vapor compression cycles in that space, so that a total thermal energy delivered meets requirements to condition the space but a portion of thermal energy delivered by each vapor compression cycle can be apportioned to minimize a total electrical power consumption of the multiple vapor compression cycles.

Figure 10:
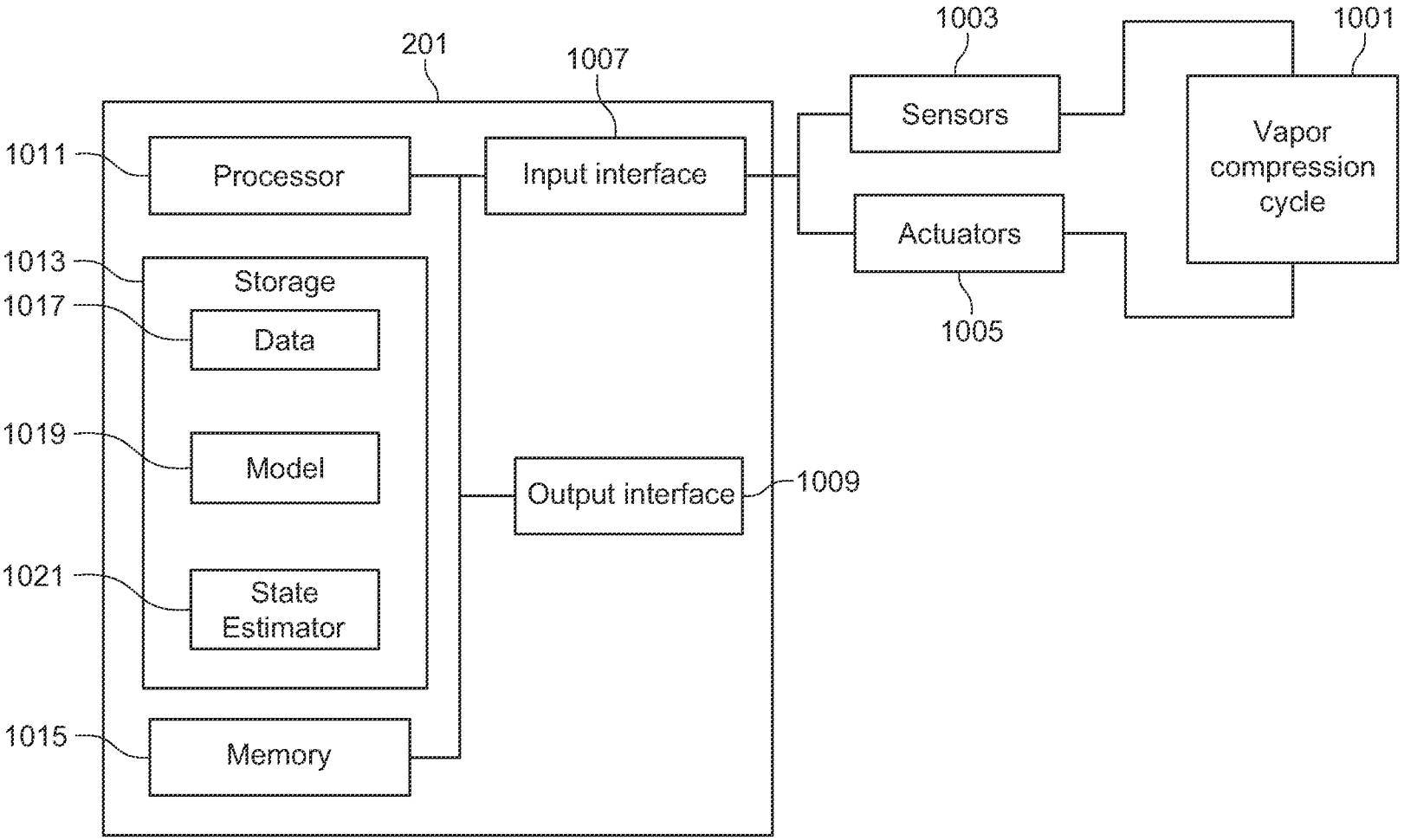
FIG. 10 shows a block diagram of the monitoring system, according to some embodiments of the present disclosure.

FIG. 10 shows a block diagram of the monitoring system 201, according to some embodiments of the present disclosure. A vapor compression system 1001 is connected to the monitoring system 201 via sensors 1003 and actuators 1005. In some embodiments, the monitoring system 201 includes an input interface 1007 connected to the sensors 1003 and to the actuators 1005, an output interface 1009 to provide the output of the monitoring system 201 to a controller, optimizer, a fault detection system, or other systems, a processor 1011, a storage 1013 and a memory unit 1015. The storage 1013 can store data 1017, a computer-implemented model program 1019 and a state estimator 1021. The computer-implemented state estimator 1021 may include the constrained ensemble Kalman smoother which is formulated in the range of the covariance for the optimization problem (program).

The input interface 1007 is configured to receive/acquire measurement data from the sensors 1003, and the output interface 1009 can be configured in different ways, depending on the application. The output interface 1009 may be configured to transmit control signals/commands to the actuators 1005 to operate the actuators 1005 according to the control commands. Additionally or alternatively, the output interface 1009 can be configured to transmit signals/commands to a fault detection system that compares the estimated state variables to existing thresholds or other fault detection techniques, and thereby identifies anomalous system operation. In some embodiments, the input interface 1007 and the output interface 1009 may be integrated into an input/output interface.

The vapor compression system 1001 includes one or more valves, one or more compressors, and two or more heat exchangers. In some cases, the vapor compression system 1001 may include variable actuators and also incorporate a controller that regulates its behavior. The vapor compression system 1001 can be configured in a manner similar to the vapor compression cycle (system) 100 described FIG. 1, which includes, at a minimum, a set of four components: the compressor 101, the condensing heat exchanger 103, the expansion valve 105, and the evaporating heat exchanger 107.

The input and output interfaces 1007 and 1009 enable the exchange of data between the various components of the monitoring system 201, including the processor 1011, the storage 1013 with the data 1017, the model 1019, and the state estimator 1021, and memory 1015. The input and output interfaces may include a communication infrastructure such as a controller area network (CAN) bus or other medium that allows data to be physically transferred through serial or parallel communication channels (e.g., copper, wire, optical fiber, computer bus, wireless communication channel, etc.).

In an embodiment, the monitoring system 201 collects a digital representation of observed variables of the operation of the vapor compression cycle (i.e., the vapor compression system 1001) over multiple instances of time via the input interface 1007. The processor 1011 executes the constrained ensemble Kalman smoother for each instance of time to estimate state variables of the vapor compression cycle for each instance of time. The constrained ensemble Kalman smoother updates the estimated state variables over a sequence of time instances within a smoothing window by solving a series of constrained optimization problems in a range of a covariance, for which the constraints are enforced for every variable in the smoothing window for every instance of the constrained optimization problems. Additionally or alternatively, the constraints may include at least one equality constraint corresponding to a slowly changing variable of the vapor compression cycle. In this case, at least one equality constraint is included in the constrained ensemble Kalman smoother, using synthetic measurements.

Further, the estimates of the state variables of the vapor compression cycle at each instance of time, are outputted via the output interface 1009. In an embodiment, these estimates of the state variables are input to the controller associated with the vapor compression cycle. The controller controls the operation of the vapor compression cycle, based on the estimates of the state variables.

The following description provides exemplary embodiments only, and is not intended to limit the scope, applicability, or configuration of the disclosure. Rather, the following description of the exemplary embodiments will provide those skilled in the art with an enabling description for implementing one or more exemplary embodiments. Contemplated are various changes that may be made in the function and arrangement of elements without departing from the spirit and scope of the subject matter disclosed as set forth in the appended claims.

Specific details are given in the following description to provide a thorough understanding of the embodiments. However, understood by one of ordinary skill in the art can be that the embodiments may be practiced without these specific details. For example, systems, processes, and other elements in the subject matter disclosed may be shown as components in block diagram form in order not to obscure the embodiments in unnecessary detail. In other instances, well-known processes, structures, and techniques may be shown without unnecessary detail in order to avoid obscuring the embodiments. Further, like reference numbers and designations in the various drawings indicate like elements.

Also, individual embodiments may be described as a process which is depicted as a flowchart, a flow diagram, a data flow diagram, a structure diagram, or a block diagram. Although a flowchart may describe the operations as a sequential process, many of the operations can be performed in parallel or concurrently. In addition, the order of the operations may be re-arranged. A process may be terminated when its operations are completed but may have additional steps not discussed or included in a figure. Furthermore, not all operations in any particularly described process may occur in all embodiments. A process may correspond to a method, a function, a procedure, a subroutine, a subprogram, etc. When a process corresponds to a function, the function's termination can correspond to a return of the function to the calling function or the main function.

Furthermore, embodiments of the subject matter disclosed may be implemented, at least in part, either manually or automatically. Manual or automatic implementations may be executed, or at least assisted, through the use of machines, hardware, software, firmware, middleware, microcode, hardware description languages, or any combination thereof. When implemented in software, firmware, middleware or microcode, the program code or code segments to perform the necessary tasks may be stored in a machine readable medium. A processor(s) may perform the necessary tasks.

Various methods or processes outlined herein may be coded as software that is executable on one or more processors that employ any one of a variety of operating systems or platforms. Additionally, such software may be written using any of a number of suitable programming languages and/or programming or scripting tools, and also may be compiled as executable machine language code or intermediate code that is executed on a framework or virtual machine. Typically, the functionality of the program modules may be combined or distributed as desired in various embodiments.

Embodiments of the present disclosure may be embodied as a method, of which an example has been provided. The acts performed as part of the method may be ordered in any suitable way. Accordingly, embodiments may be constructed in which acts are performed in an order different than illustrated, which may include performing some acts concurrently, even though shown as sequential acts in illustrative embodiments.

Although the present disclosure has been described with reference to certain preferred embodiments, it is to be understood that various other adaptations and modifications can be made within the spirit and scope of the present disclosure. Therefore, it is the aspect of the appended claims to cover all such variations and modifications as come within the true spirit and scope of the present disclosure.

We claim:

1. A monitoring system for monitoring an operation of a vapor compression cycle, the monitoring system comprising: a processor; and a memory having instructions stored thereon that, when executed by the processor, cause the monitoring system to:

collect a digital representation of observed variables of the operation of the vapor compression cycle over multiple instances of time;

execute a constrained ensemble Kalman smoother for each instance of time to estimate state variables of the vapor compression cycle for each instance of time, wherein the constrained ensemble Kalman smoother updates the state variables over a sequence of time instances within a smoothing window by solving a series of constrained optimization problems in a range of a covariance, for which constraints are enforced for every variable in the smoothing window for every instance of the constrained optimization problems, and output, based on the estimates of the state variables, estimates of variables of the vapor compression cycle at each instance of time.

2. The monitoring system of claim 1, wherein the constraints include a decrement of a refrigerant pressure in a direction of flow.

3. The monitoring system of claim 1, wherein the state variables include the observed variables and unobserved variables.

4. The monitoring system of claim 3, wherein the observed variables include measurements of one or more of a temperature and a pressure, at different locations in the vapor compression cycle.

5. The monitoring system of claim 3, wherein the unobserved variables of the vapor compression cycle include an amount of refrigerant in the vapor compression cycle.

6. The monitoring system of claim 5, wherein the processor is further configured to detect a leakage of the refrigerant, based on an estimated amount of refrigerant in the vapor compression cycle.

7. The monitoring system of claim 6, wherein, to detect the leakage of the refrigerant based on the estimated amount of refrigerant in the vapor compression cycle, the processor is further configured to:

compare the estimated amount of refrigerant in the vapor compression cycle and a threshold; and detect, based on the comparison, the leakage of the refrigerant.

8. The monitoring system of claim 1, wherein the constraints include at least one equality constraint corresponding to a slowly changing variable of the vapor compression cycle.

9. The monitoring system of claim 8, wherein the at least one equality constraint is included in the constrained ensemble Kalman smoother, using synthetic measurements.

10. The monitoring system of claim 3, wherein the unobserved variables of the vapor compression cycle include thermal energy delivered by one or more heat exchangers of the vapor compression cycle.

11. The monitoring system of claim 3, wherein the unobserved variables of the vapor compression cycle include a thermodynamic quality of the refrigerant flow at an inlet or outlet of one or more heat exchangers of the vapor compression cycle.

12. The monitoring system of claim 1, wherein the processor is further configured to transmit the digital representation of observed variables of the operation of the vapor compression cycle to a remote server for storage.

13. The monitoring system of claim 12, wherein the remote server is configured to:

execute the constrained ensemble Kalman smoother for each instance of time to estimate the state variables of the vapor compression cycle for each instance of time; and transmit the estimates of the variables of the vapor compression cycle to a remote operator.

14. The monitoring system of claim 13, wherein the processor is further configured to receive the estimates of the variables of the vapor compression cycle.

15. The monitoring system of claim 1, wherein the processor is further configured to schedule a maintenance service for the vapor compression cycle, based on the estimates of the variables of the vapor compression cycle.

16. A method for monitoring an operation of a vapor compression cycle, the method comprising:

collecting digital representation of observed variables of the operation of the vapor compression cycle over multiple instances of time;

executing a constrained ensemble Kalman smoother for each instance of time to estimate state variables of the vapor compression cycle for each instance of time, wherein the constrained ensemble Kalman smoother updates the state variables over a sequence of time instances within a smoothing window by solving a series of constrained optimization problems in a range of a covariance, for which constraints are enforced for every variable in the smoothing window for every instance of the constrained optimization problems, and outputting, based on the estimates of the state variables, estimates of variables of the vapor compression cycle at each instance of time.

17. The method of claim 16, wherein the state variables include the observed variables and unobserved variables.

18. The method of claim 17, wherein the observed variables include measurements of one or more of a temperature and a pressure, at different locations in the vapor compression cycle.

19. The method of claim 17, wherein the unobserved variables of the vapor compression cycle include an amount of refrigerant in the vapor compression cycle.

20. The method of claim 19, wherein the method further comprises detecting a leakage of the refrigerant, based on the estimated amount of refrigerant in the vapor compression cycle.

21. The method of claim 20, wherein, to detect the leakage of the refrigerant based on the estimated amount of refrigerant in the vapor compression cycle, the method further comprises:

comparing the estimated amount of refrigerant in the vapor compression cycle and a threshold; and detecting, based on the comparison, the leakage of the refrigerant.

22. The method of claim 17, wherein the unobserved variables of the vapor compression cycle include thermal energy delivered by one or more heat exchangers of the vapor compression cycle.

23. A non-transitory computer-readable storage medium embodied thereon a program executable by a processor for monitoring an operation of a vapor compression cycle, the method comprising:

collecting digital representation of observed variables of the operation of the vapor compression cycle over multiple instances of time;

executing a constrained ensemble Kalman smoother for each instance of time to estimate state variables of the vapor compression cycle for each instance of time, wherein the constrained ensemble Kalman smoother updates the state variables over a sequence of time instances within a smoothing window by solving a series of constrained optimization problems in a range of a covariance, for which constraints are enforced for every variable in the smoothing window for every instance of the constrained optimization problems, and outputting, based on the estimates of the state variables, estimates of variables of the vapor compression cycle at each instance of time.

* * * * *